US009032889B2

(12) United States Patent
Payne

(10) Patent No.: US 9,032,889 B2
(45) Date of Patent: May 19, 2015

(54) CARTRIDGE SELECTION MECHANISM FOR A SEWING MACHINE

(75) Inventor: Thomas Andrew Payne, Arlington, TN (US)

(73) Assignee: BROTHER INTERNATIONAL CORPORATION, Bridgewater, NJ (US)

( * ) Notice: Subject to any disclaimer, the term of this patent is extended or adjusted under 35 U.S.C. 154(b) by 1083 days.

(21) Appl. No.: 13/041,234

(22) Filed: Mar. 4, 2011

(65) Prior Publication Data

US 2012/0222594 A1 Sep. 6, 2012

(51) Int. Cl.
*D05B 1/02* (2006.01)
*D05B 69/00* (2006.01)
*D05C 11/06* (2006.01)

(52) U.S. Cl.
CPC *D05B 1/02* (2013.01); *D05B 69/00* (2013.01); *D05C 11/06* (2013.01)

(58) Field of Classification Search
CPC ..... D05B 1/02; D05B 69/00; D05C 11/06
USPC ..... 112/302, 254, 241, 186, 221, 225; 242/118, 134–140, 170, 171, 593
See application file for complete search history.

(56) References Cited

U.S. PATENT DOCUMENTS 3,269,671 A * 8/1966 Cole, Jr. ..... 242/326.3
3,385,247 A 5/1968 Johnson et al.
3,749,039 A 7/1973 Fritts
4,077,339 A 3/1978 Bass et al.
4,100,867 A 7/1978 Bass et al.
4,183,313 A * 1/1980 Odermann et al. ..... 112/302
4,319,532 A 3/1982 Fogarty et al.
4,408,554 A 10/1983 Takiguchi et al.
4,548,145 A 10/1985 Hirose
4,566,396 A 1/1986 Sakuma et al.
4,669,406 A 6/1987 Muroya
5,063,866 A * 11/1991 Jimenez et al. ..... 112/302
5,441,003 A 8/1995 Hashride
5,461,997 A 10/1995 Landén
5,682,830 A * 11/1997 Katou et al. ..... 112/225
5,792,153 A 8/1998 Swain et al.
5,803,001 A 9/1998 Shimizu et al.
5,881,660 A * 3/1999 Hiramatsu et al. ..... 112/302
6,135,038 A 10/2000 Okamoto
6,467,419 B2 10/2002 Hori
6,513,742 B2 * 2/2003 Watson ..... 242/171

(Continued)

OTHER PUBLICATIONS

Operation Manual (Computerized Sewing Machine S2_brotherE-Cover2fm p. A-p. 109, dated Mar. 30, 2004.

(Continued)

*Primary Examiner* — Danny Worrell
(74) *Attorney, Agent, or Firm* — Frommer Lawrence & Haug LLP

(57) ABSTRACT

A sewing apparatus and method therefor includes a drive mechanism, a thread feed mechanism, and a needle engagement mechanism for engaging the thread feed mechanism. The drive mechanism comprises a drive motor configured to transmit power from the drive motor to the needle engagement mechanism such that it drives a needle within a cartridge without moving the entire cartridge. A method and sewing apparatus includes a plurality of thread feed mechanisms and a needle engagement mechanism for selecting and engaging each of the thread feed mechanisms.

28 Claims, 16 Drawing Sheets

(56) References Cited

U.S. PATENT DOCUMENTS

| | | | | |
|---|---|---|---|---|
| 6,543,374 | B2 | 4/2003 | Terao | |
| 6,641,598 | B2 | 11/2003 | Shimizu et al. | |
| 6,694,904 | B2 | 2/2004 | Mamiya | |
| 6,712,014 | B2 | 3/2004 | Mamiya et al. | |
| 6,729,252 | B2 * | 5/2004 | Wada et al. | 112/278 |
| 6,729,253 | B2 | 5/2004 | Mamiya et al. | |
| 6,729,254 | B2 | 5/2004 | Mamiya et al. | |
| 6,748,886 | B2 | 6/2004 | Shimizu | |
| 6,814,014 | B2 | 11/2004 | Mamiya | |
| 6,814,016 | B2 * | 11/2004 | Hori | 112/225 |
| 6,860,212 | B2 * | 3/2005 | Fukao | 112/225 |
| 6,883,447 | B1 * | 4/2005 | Kitazawa | 112/302 |
| 6,981,459 | B2 * | 1/2006 | Kitazawa et al. | 112/225 |
| 7,100,524 | B2 * | 9/2006 | Sakakibara et al. | 112/225 |
| 7,114,455 | B2 * | 10/2006 | Prufer et al. | 112/302 |
| 7,210,418 | B2 * | 5/2007 | Sakakibara | 112/302 |
| 8,731,704 | B2 * | 5/2014 | Corio | 700/137 |
| 2004/0000263 | A1 * | 1/2004 | Sakakibara | 112/470.01 |

OTHER PUBLICATIONS

Feature Web pages for pro PR-1000, 10-needle home embroidery machine, (The Perfect 10 in Embroidery) Copright 2010 Brother International Corporation, Printed Mar. 4, 2011 and Jul. 12, 2011.

* cited by examiner

Downward Needle Movement

Upward Needle Movement

CARTRIDGE SELECTION MECHANISM FOR A SEWING MACHINE

BACKGROUND OF THE INVENTION

1. Field of the Invention

The present invention relates to a sewing apparatus and methods therefor.

2. Description of Related Art

An alternative to conventional lockstitch embroidery employs a replaceable cartridge containing a needle and embroidery thread, supplied pre-threaded by means of a hollow needle of the type commonly used for intravenous injection. A stitching mechanism creates underside loops retained in the workpiece by friction. A subsequent operation permanently secures the underside loops with adhesive.

Extant machines of this type have the capacity to install only a single cartridge at one time, such that an embroidery pattern of several colors requires several cartridge changes performed by the user, interrupting an otherwise automated process. Embroidery patterns commonly comprise eight or more colors, resulting in a tedious operation to produce a single finished workpiece.

SUMMARY OF THE INVENTION

A machine containing multiple cartridges installed concurrently promises greatly enhanced utility and convenience by reducing the number of user interventions per finished workpiece. For example, a machine with capability to hold and sequentially operate four cartridges can reduce the number of user interventions required to produce an eight-color pattern from seven to just one. Exemplary advantages include reducing the quantity and mass of moving parts per needle and selectively engaging the operation of a desired cartridge through cooperative employment of existing machine mechanisms.

Disclosed is a sewing apparatus comprising: a drive mechanism; a thread feed mechanism comprising a removable cartridge; and a needle engagement mechanism for engaging the thread feed mechanism, wherein the drive mechanism comprises a drive motor configured to transmit power from the drive motor to the needle engagement mechanism such that it drives a needle within the cartridge without moving the entire cartridge.

Also disclosed is sewing apparatus comprising: a plurality of thread feed mechanisms and a needle engagement mechanism for selecting and engaging each of the thread feed mechanisms.

Also disclosed is method comprising: positioning a needle engagement mechanism to engage at least one thread feed mechanism, the thread feed mechanism comprising a removable cartridge.

DETAILED DESCRIPTION OF EMBODIMENTS

Figure 1A:
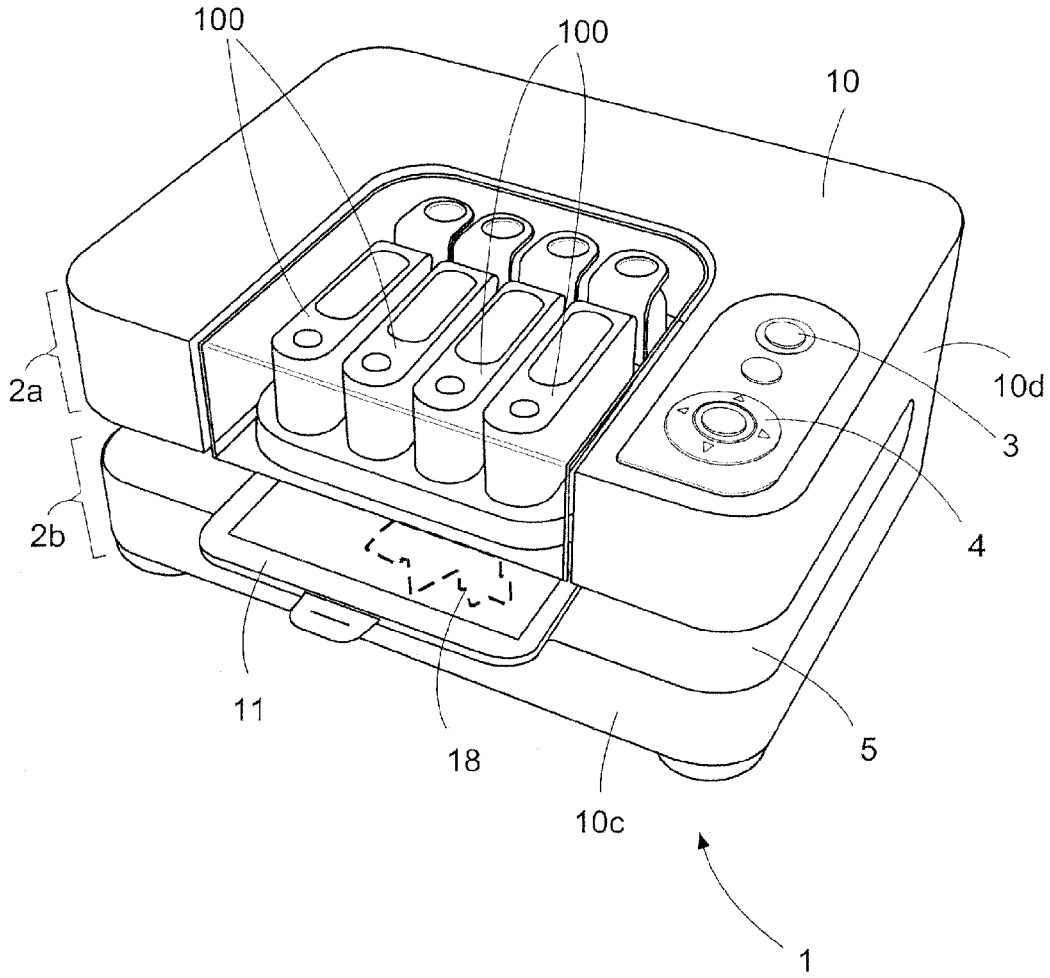
FIGS. 1A-1C show a sewing apparatus.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The use of the terms "a", "an", "at least one", "one or more", and similar terms indicate one of a feature or element as well as more than one of a feature. The use of the term "the" to refer to the feature does not imply only one of the feature and element.

When an ordinal number (such as "first", "second", "third", and so on) is used as an adjective before a term, that ordinal number is used (unless expressly or clearly specified otherwise) merely to indicate a particular feature, such as to distinguish that particular feature from another feature that is described by the same term or by a similar term.

When a single device, article or other product is described herein, more than one device/article (whether or not they cooperate) may alternatively be used in place of the single device/article that is described. Accordingly, the functionality that is described as being possessed by a device may alternatively be possessed by more than one device/article (whether or not they cooperate). Similarly, where more than one device, article or other product is described herein (whether or not they cooperate), a single device/article may alternatively be used in place of the more than one device or article that is described. Accordingly, the various functionality that is described as being possessed by more than one device or article may alternatively be possessed by a single device/article.

The functionality and/or the features of a single device that is described may be alternatively embodied by one or more other devices which are described but are not explicitly described as having such functionality/features. Thus, other embodiments need not include the described device itself, but rather can include the one or more other devices which would, in those other embodiments, have such functionality/features.

The present invention will now be described in detail on the basis of exemplary embodiments.

FIGS. 1A to 1D show a sewing apparatus 1, embodied as an embroidery apparatus. The sewing apparatus includes a sewing apparatus body 2, safety cover 15 hingedly attached to the sewing apparatus body 2, an embroidery frame 11, and a plurality of sewing cartridges 100*a*, 100*b*, 100*c*, 100*d*. The embroidery frame 11 and the sewing cartridges 100 are detachably attached to the sewing apparatus body 2. A workpiece 18 to be sewn is held in the embroidery frame 11, and a hollow needle 102 capable of penetrating into the workpiece 18 is provided in each sewing cartridge 100.

The sewing apparatus body 2 includes a casing 10, an embroidery frame driving mechanism 9 that moves the embroidery frame 11 having the work cloth 18 in a horizontal plane with respect to the hollow needle 102 while the embroidery frame 11 is held by a carriage 9. The body 2 also comprises and a selective engagement mechanism (See FIGS. 4A-4C) for selecting a cartridge 100 from the plurality of cartridges 100*a*, 100*b*, 100*c*, 100*d*.

The casing 10 is a relatively small rectangular solid. For example, in one embodiment the casing 10 may be 14 inches (356 mm) long, 9½ (241 mm) inches wide and 5½ inches (139 mm) high. The casing 10 contains main parts of the embroidery frame driving mechanism 9 and the cartridge driving mechanism 109, and the selective engagement mechanism 200.

A slot 5, allows access of the embroidery frame 11 into the apparatus 1 for sewing during operation of the apparatus 1. In one embodiment, the slot 5 extends in a lateral direction along a front wall 10*c* of the apparatus 1, and is formed in a front wall 10*c* between a base portion 2*b* and a top portion 2*a* of the apparatus 1. In another embodiment, the casing 10 is formed as a unitary body (as shown in FIG. 1A) and the slit 5 is runs laterally along a front wall 10*c* and partially down the side walls 10*b*, 10*d* of the casing 10. The slit 5 is provided as to attach the embroidery frame 11 to an engagement mechanism 20 to engage the embroidery frame 11 to the embroidery frame driving mechanism 9 and to move the embroidery frame 11 in a horizontal plane. On the right side of the upper surface 10*a* is a power switch 3, and a start/stop switch 4 that starts and stops the sewing. Upper surfaces of the power switch 3 and the start/stop switch 4 are positioned at the same or a slightly lower level than the upper surface of the upper wall 10*a*.

Figure 1B:
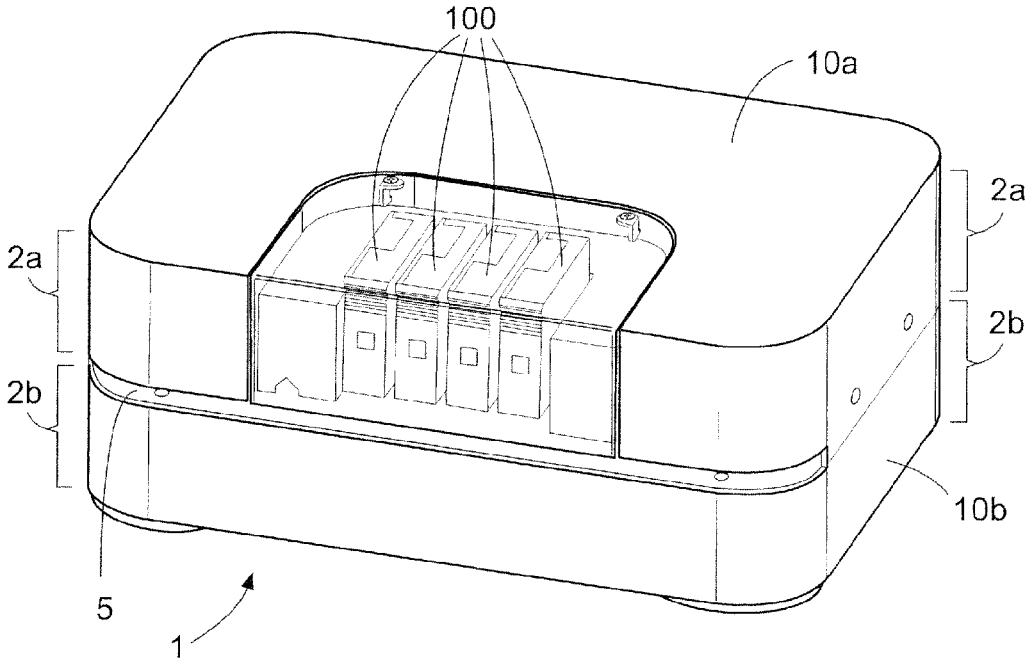
Figure 1C:
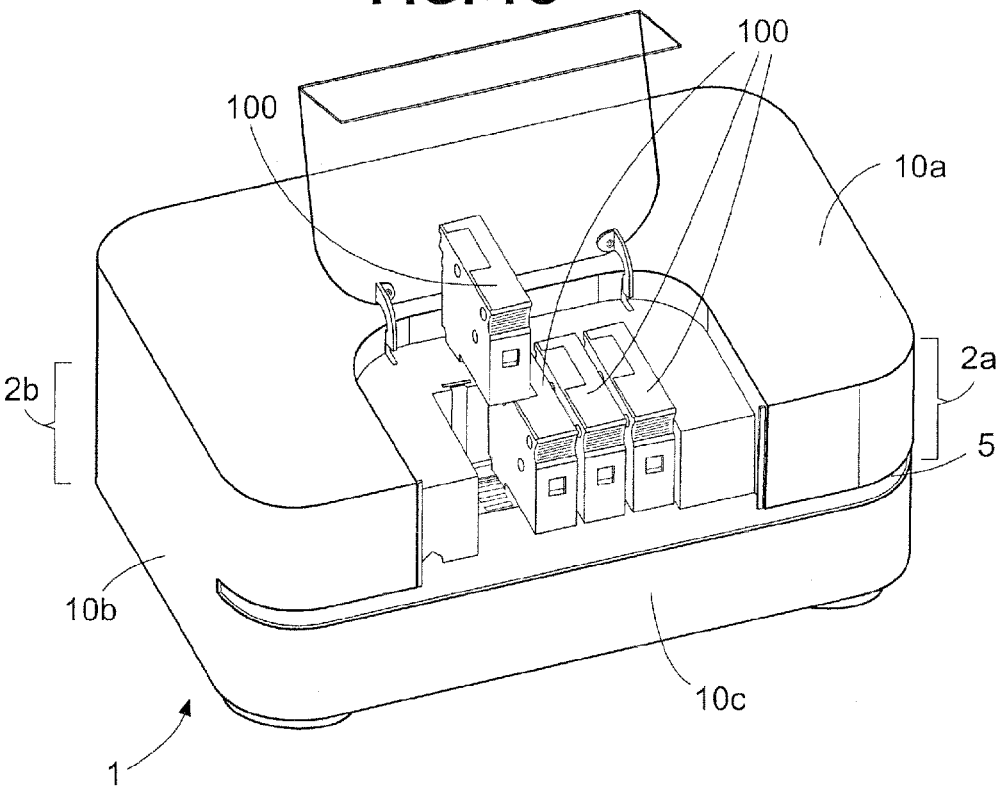
Figure 1D:
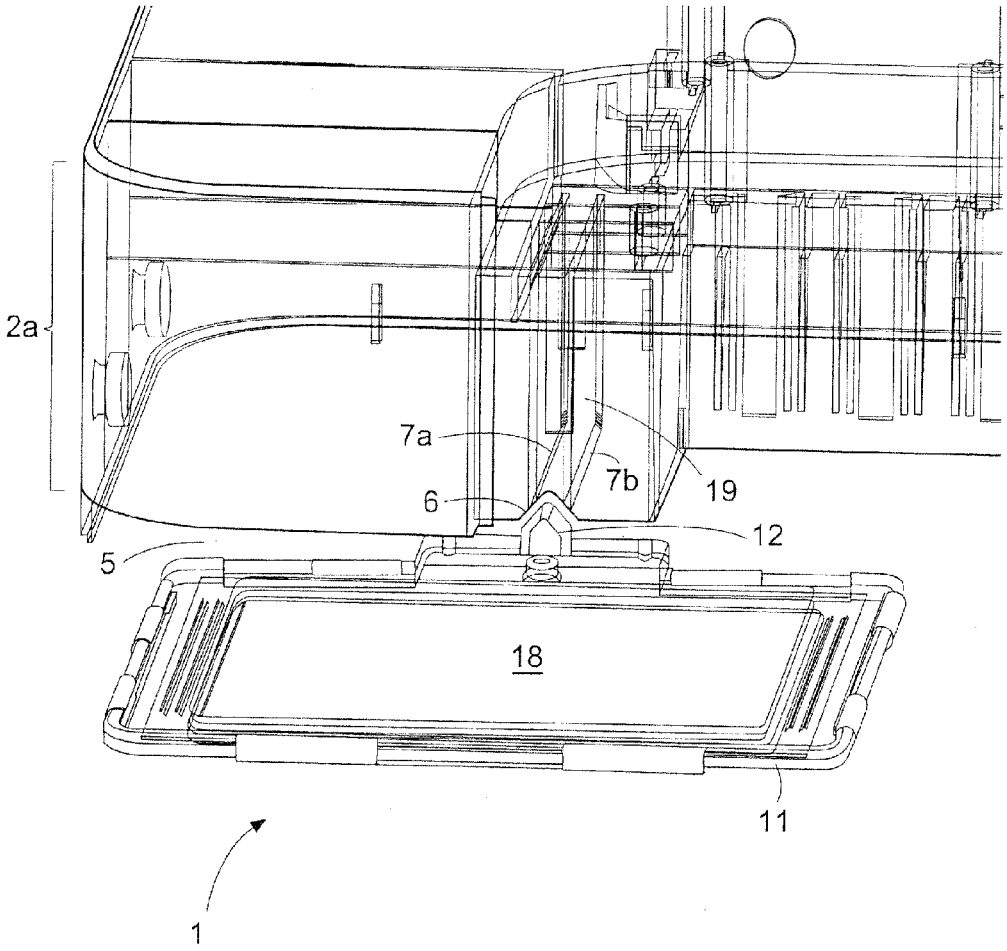
FIG. 1D shows a cutaway perspective view of an upper body and an embroidery frame of the sewing apparatus.

FIG. 1D shows a cutaway perspective view of the upper body 2*a* and an embroidery frame 11, in an embodiment where the upper body 2*a* forms a cover portion of the sewing machine 1. The apparatus 1 comprises a removable embroidery frame 11, a body 2 of the apparatus, and a frame and drive engagement mechanism 50 (See FIG. 3) for engaging the frame to a frame driving mechanism 9. The apparatus 1 further comprises at least one mating alignment feature 6, 12 for engaging the frame 11 with the apparatus, wherein the mating alignment feature allows engagement of the embroidery frame to the apparatus where the frame and drive engagement mechanism 50 are at least partially obscured.

In the embodiment, the mating alignment feature further comprises a frame alignment feature 12 on the embroidery frame 11 and a body mating alignment feature 6 corresponding to the frame alignment feature. With respect to the front side 10*a* of the upper body 2*a* of the cover, a raised alignment feature 12 is added to the leading edge of the embroidery hoop 11 where the leading edge is to be inserted into the engagement mechanism 20 within the embroidery apparatus 1. To enable correct insertion of the embroidery hoop 11 into the sewing apparatus 1, a cutout 6 of a shape corresponding to the raised feature 12 on the embroidery frame 11 allows clearance through the top portion 10*a* of the embroidery machine 1. The cutout 6 is positioned on the front face 10*c* of the top portion 2*a* to facilitate direct access to the frame and drive engagement mechanism 50 (See FIG. 3) within the machine. As shown in the embodiment, the cutout 6 has a negative space profile that corresponds to the shape of the raised alignment feature 12.

It will be noted that although the present embodiment has the raised alignment feature 12 on the frame 11 and the cutout alignment feature 6 on the body 2, the frame could be made in an embodiment (not shown) such that the cutout feature 6 is on the frame and the raised feature 12 is on the body 2*a* (e.g., via a groove cutout feature 6 and raised feature 12 comprising guide element 7 formed as a notched rail 12 on the underside of the upper body 2*a*).

Figure 3:
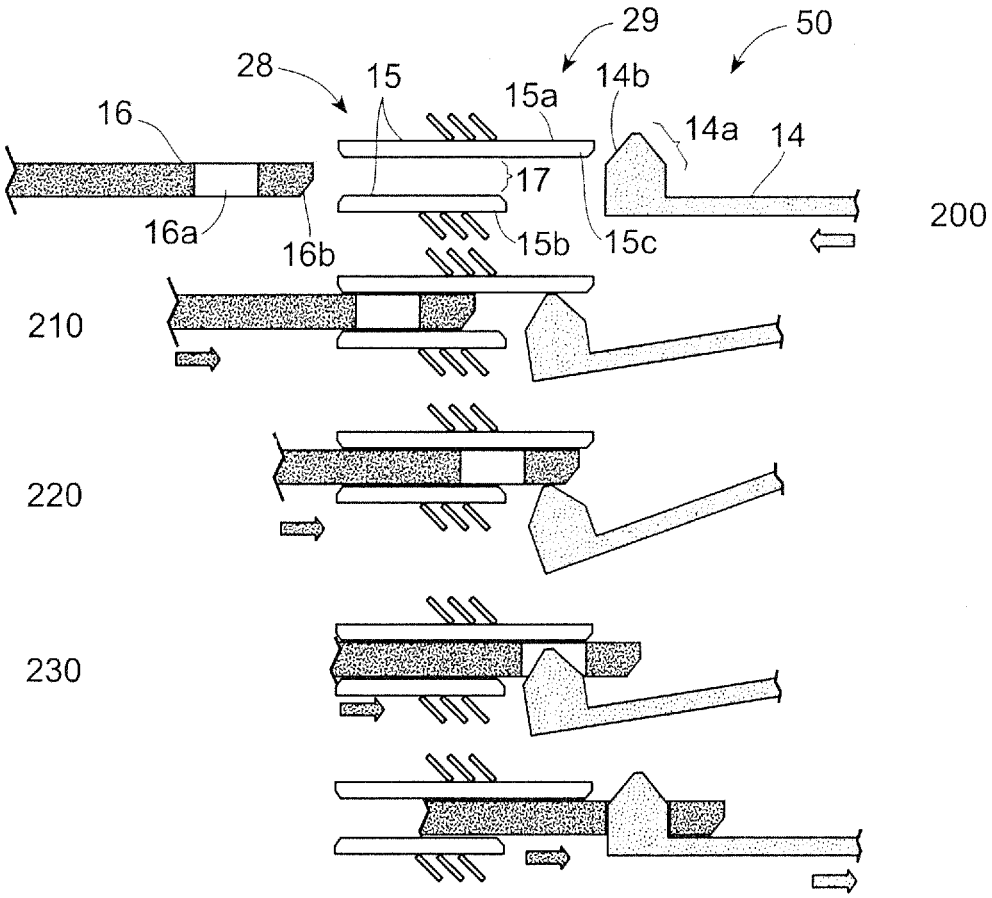
FIG. 3 shows profile views of frame engagement mechanism arranged as a schematic flow showing the operation sequence thereof.

The apparatus further comprises a guide element 7, shown as a guide channel 7 configured such that the embroidery frame 11 can be moved through the body to a point of engagement with the frame and drive engagement mechanism 50 (FIG. 3). A guide channel 7 is provided within the top portion 2*b*, leading from the cutout opening 6 of the upper body portion 2*a* to the point of engagement with the engagement mechanism 20. In this way, reliable engagement of the embroidery frame 11 with embroidery frame driving mechanism 9 is assured, even though the frame engagement and drive mechanism 50 is hidden or at least partially obscured from the view of the operator (as is the case in the present embodiment where the body 2*a* obscures the view if not made of a transparent material). As shown in FIG. 1D, the guide channel comprises sloped rail elements 7*a*, 7*b* that correspond to the shape of the cutout 6.

The raised alignment feature 12 of the embroidery hoop 11 is larger than the slot 5, through which the frame 11 otherwise passes into the machine 1 during both frame 11 insertion and machine 1 operation. Accordingly, this raised feature 12 effectively prevents insertion of the embroidery frame 11 into the machine 1 to the degree that the frame 11 may be lost accidentally from the reach of the operator's finger grip.

The mating alignment features 6, 12 of the upper body 2*b* and the frame 11 of the machine cover are chosen to be of a distinct and easily recognizable shape, thereby facilitating intuitive recognition of the insertion direction. Thus while the raised feature 12 and the cutout 6 both take a similar polygonal form as shown in FIG. 1D, other such intuitively recognizable shapes could be chosen (such as semi-circular, square, or even a whimsical design element such as a clover, a distinctive symbol or mark, or an animated character's profile). Once aligned, a latching mechanism 14 for the engagement frame 11 is further operated by intuitive, tactile push/pull engagement and disengagement of the frame 11, which is described in more detail below (See FIG. 3).

Figure 2A:
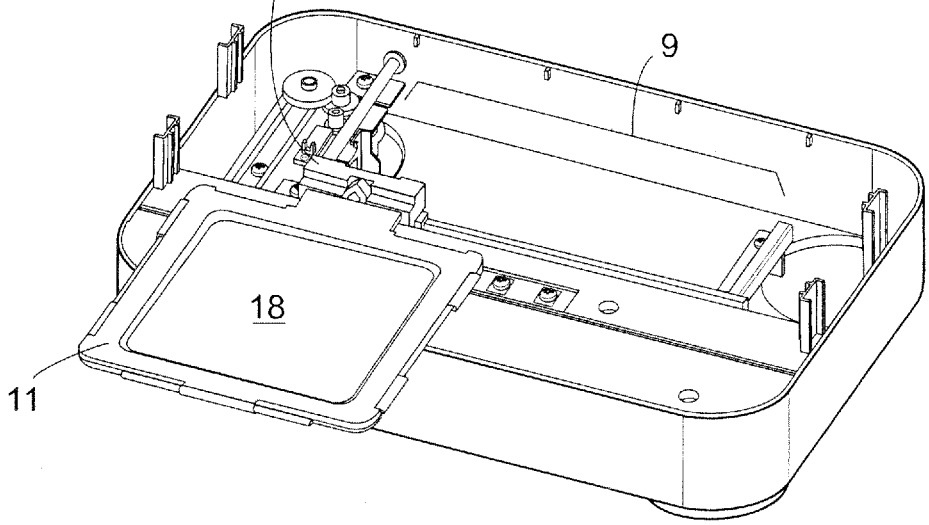
FIGS. 2A and 2B show, respectively, a cutaway perspective view and plan view of the base portion of the sewing apparatus showing an embroidery frame driving mechanism.
Figure 2B:
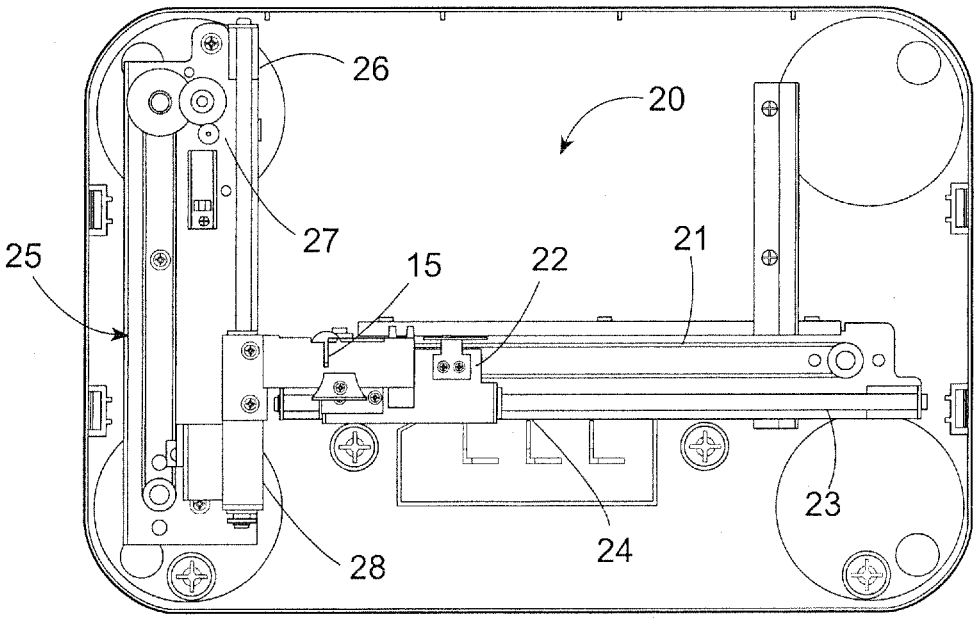

A latching mechanism 14 for the engagement frame 11 is further operated by intuitive, tactile push/pull engagement and disengagement of the engagement frame 11 once aligned, using the intuitive mating alignment features 6, 12 as shown in FIG. 1D. The latching mechanism 44 engages with a frame driving mechanism 9 for moving the workpiece 18 in the horizontal plane within the embroidery machine 1. As shown in FIGS. 2A and 2B, the carriage 9 has an engagement portion 16 that can engage/disengage an installation portion 14 of the embroidery frame 11 thereto/therefrom.

FIGS. 2A and 2B are respectively a cutaway perspective view and plan view of the base portion 2*b* of the sewing apparatus 1 showing the embroidery frame driving mechanism 9. An exemplary embroidery frame driving mechanism which can be employed in the embodiments of the invention described herein is also shown in U.S. Pat. Nos. 6,729,253 and 6,729,254, the entirety of each of which is incorporated by reference herein. The embroidery frame driving mechanism 9 includes the carriage 8 to which the embroidery frame 11 is detachably attached, an X-axis direction driving mechanism 20 that drives the carriage 8 in an X direction (the left-right direction as shown) within a horizontal plane, and a Y-axis direction driving mechanism 25 that drives the carriage 8 in a Y direction (the front and rear direction as shown) perpendicular, within the horizontal plane, to the X direction.

The X-axis direction driving mechanism 20 includes a moving frame 24, an X-axis slider 22 attached to a X-axis drive belt 21, and an X-axis guide shaft 23. The driving mechanism 20 is operatively connected to a drive motor 29. The moving frame 21 is rectangular moves with a Y-axis slider 28. The guide shaft 23 is supported at its ends by side walls of the moving frame 21.

The Y-axis direction driving mechanism 25 includes the Y-axis slider 28 attached to a Y-axis belt drive belt 27 and a Y-axis guide shaft 26. The Y-axis direction driving mechanism 25 is also operatively connected to a drive motor 29.

The Y-axis slider 28 is disposed under and attached to the X-axis direction driving mechanism 20, such that the moving frame 21 moves with the Y-axis slider 28.

An embodiment of the frame and drive engagement mechanism 50 is shown at FIG. 3. The engagement mechanism includes a fixed guide 15, comprising a channel 17 formed by at least one guide member 15 and a latch mechanism 14 configured to engage a frame catch member 16 on the frame to the frame driving mechanism 9. The channel 17 is configured to position the latch mechanism 14 and the catch member 16 such that the latch mechanism 14 engages and disengages the frame catch member 16 at a fixed location 19. A controller 70 (discussed below) controls the frame driving mechanism 9, and is configured to position the latch mechanism at the fixed location 16. The channel 17 has a drive engagement side 29 and a frame engagement side 28.

Figure 6A:
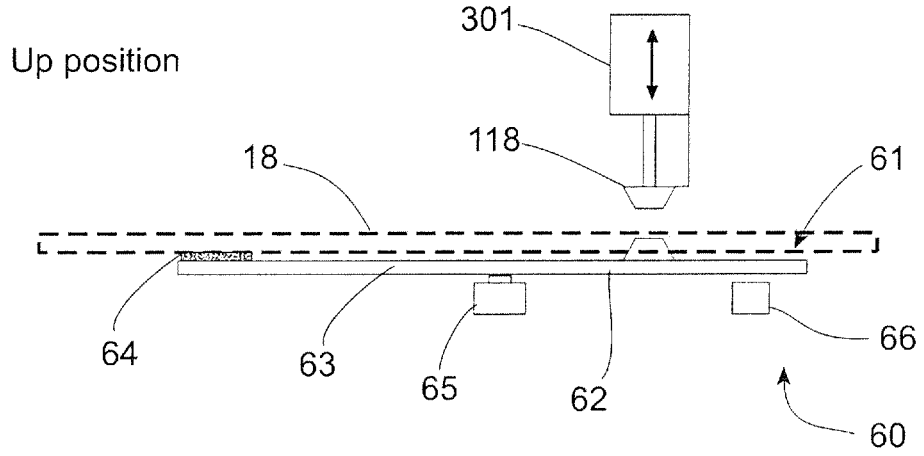
FIGS. 6A-6E show embodiments of a detection device.
Figure 6B:
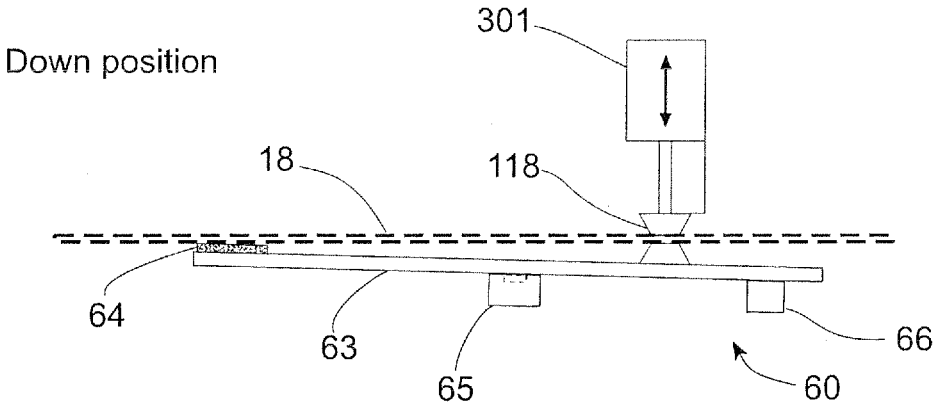
Figure 6E:
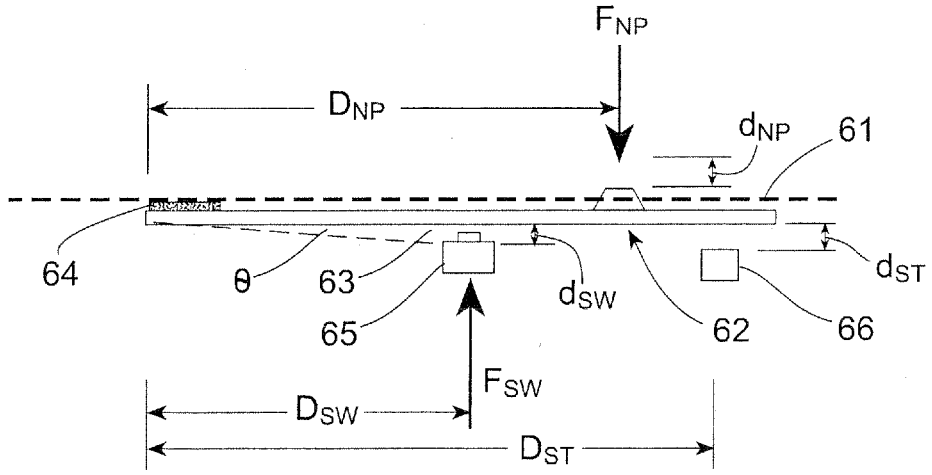
Figure 6C:
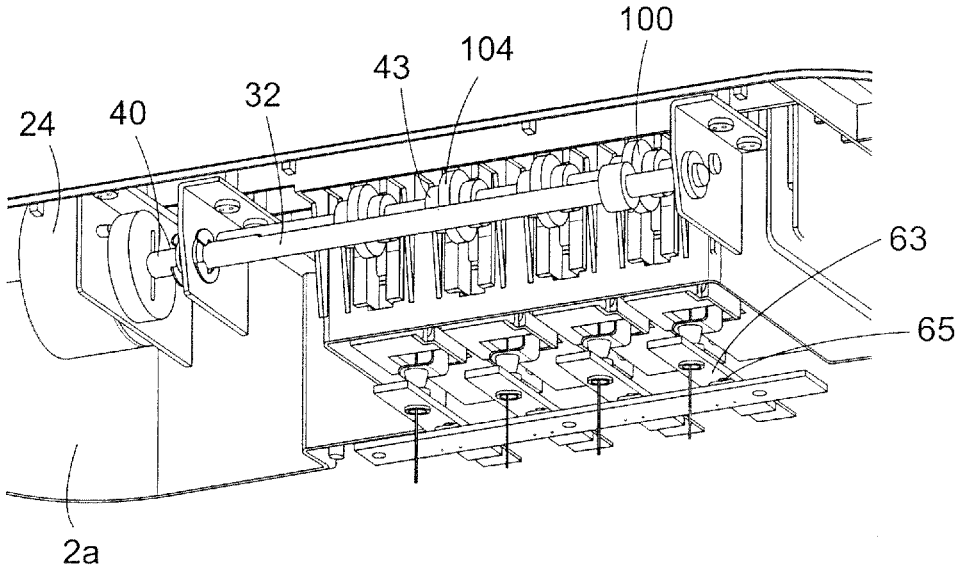
Figure 6D:
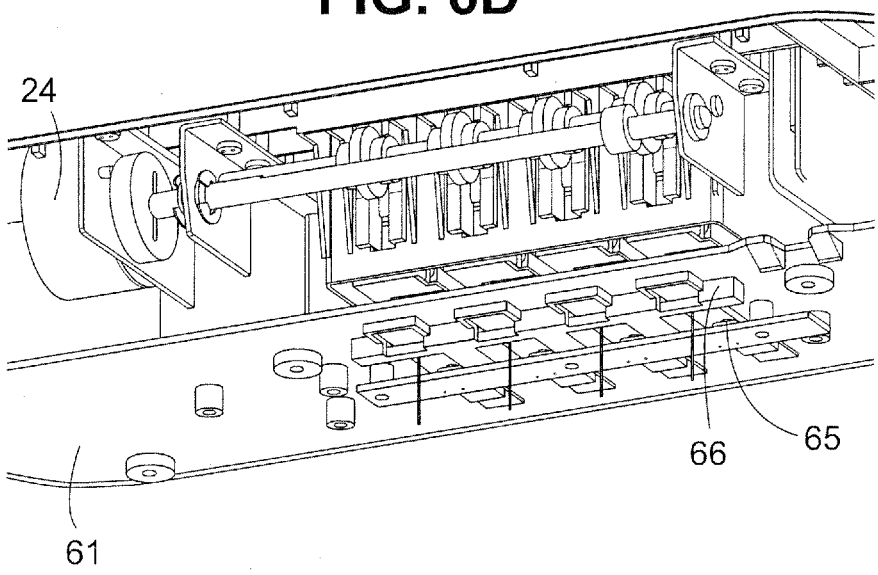
Figure 7:
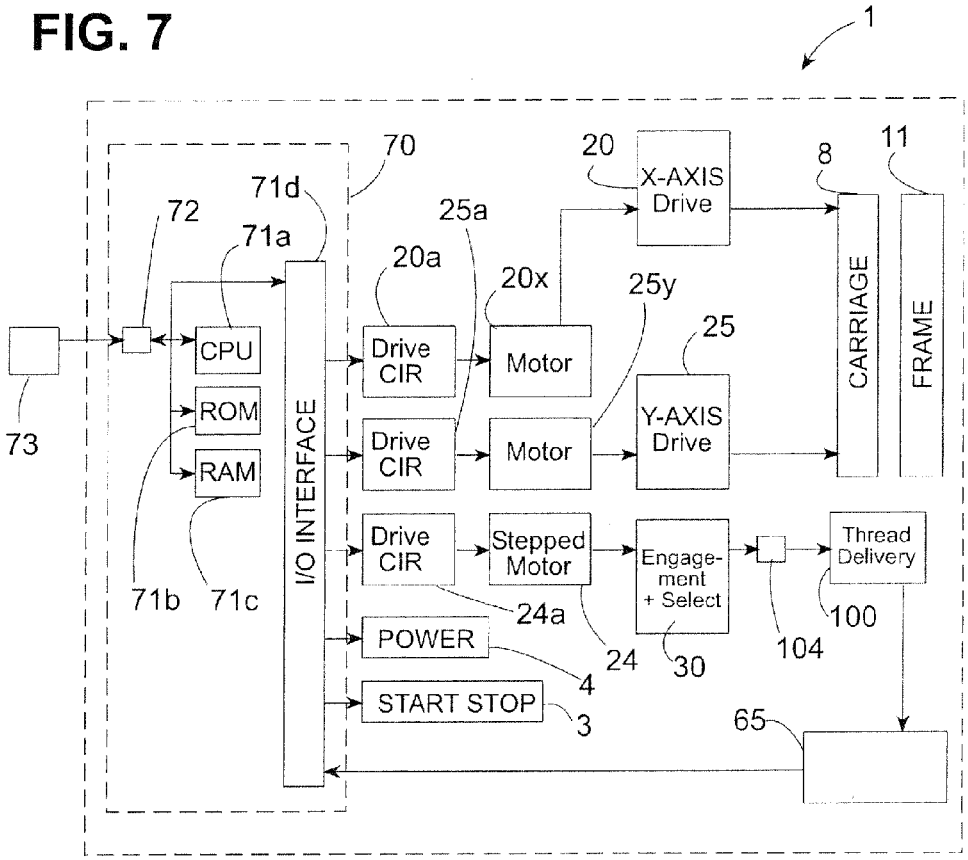
FIG. 7 shows a controller for the sewing apparatus.

As shown in FIG. 7, the controller 70 of the sewing apparatus 1 has a computer 71, which includes a CPU 71*a*, a ROM 71*b*, a RAM 71*c*, an input/output interface 71*d*, and an input/output terminal 71*e*. The CPU 71*a*, the ROM 71*b*, the RAM 71*c*, the input/output interface 71*d*, and the input/output terminal 71*e* are operatively connected to each other, as for example via a bus. The input/output interface 71*d* is connected with a drive circuit 20*a* for the pulse motor 20*x* of the X-axis direction driving mechanism 20, a drive circuit 25*a* for the pulse motor 25*y* of the Y-axis direction driving mechanism 25, a drive circuit 24*a* for the drive motor 24 of the thread feed and engagement driving mechanism 30, the power switch, and the start/stop switch 4. Exemplary controller and computer systems that can be used in conjunction with the present invention are described in U.S. Pat. Nos. 6,729,253 and 6,729,254, the entirety of each of which is incorporated by reference herein. Also shown is a sensor 65 forming part of a detection mechanism 60 (See FIG. 6A-FIG. 6E) operatively connected to the CPU 71*a*, the ROM 71*b*, the RAM 71*c*, the input/output interface 71*d*, and the input/output terminal 71*e*.

The controller 70 includes a drive 72 capable of reading and writing instructions from memory 73, including internal memory or memory from a stored memory device 73. The drive 72 can be any device configured to read memory such as flash drives, CDs or DVDs, cartridges, memory cards, and other like devices, and includes hardware for interfacing therewith. The stored memory device can be an external storage medium, such as a memory cartridge, memory card, flash drive, CD or DVD, or other like device. The stored memory device can even comprise remote storage 73*b* transmitted over WAN or LAN networks, including those such as in cloud computing and storage systems. The memory 73 stores various sewing data and programs, so that the sewing data and the programs are readable by the computer 71. Similarly, the control programs, the control signals, and the data may be distributed worldwide via the Internet.

In the sewing apparatus 1, an embroidery pattern can be formed on the workpiece 18 by controlling the embroidery frame driving mechanism 29 (the X-axis direction driving mechanism 20 and the Y-axis direction driving mechanism 25) and the thread feed driving mechanism 100 by the controller 70 based on the sewing data. A control program for sewing is stored in the ROM 71*b*.

The memory storage 73 stores various kinds of embroidery patterns, pattern data of various kinds for prestored embroidery patterns, and a pattern selection control program for selecting a desired embroidery pattern from the various kinds of embroidery patterns. The memory storage 73 also can include a pattern edit control program for editing (e.g., enlargement, reduction, unification, reversal) a selected embroidery pattern, and a display control program for displaying an embroidery pattern for selecting and setting on a display (not shown). For example a flash card 73, connectable to the flash card connector, can store pattern data of a selected/edited embroidery pattern.

FIG. 3 shows profile views arranged as a schematic flow showing the operation sequence designed to position the latching mechanism 14 at a specific position of engagement and disengagement when the installation or removal of the embroidery hoop 11 is indicated. The controller 70 includes machine software and hardware (See FIG. 7) that controls this movement. By interaction with the upper body 2*a* cover of the machine at a specific location, the latching mechanism 14 is designed to allow manual disengagement of the embroidery hoop 11. In this way, accidental disengagement of the hoop from the machine during other modes of operation can be prevented.

As shown in FIG. 3 (at 200), the latch mechanism 14 is moved into an engagement position against a fixed guide member 15. In the current embodiment, the engagement position is a channel 17 formed by two fixed guide members 15*a*, 15*b*. The controller 70 moves the drive-side 29 frame engagement mechanism 14 to the fixed guide members 15*a*, 15*b* from the drive engagement side 29 to a frame engagement position 19.

The catch member 16 on the frame engages the latch mechanism 14 at the engagement position 19. The one guide member 15*b* is shorter than the other guide member 15*a*. This allows the latch mechanism 14 to move into a stationary engagement/disengagement position by abutting the shorter guide member 15*b*, and sliding underneath the longer guide member such that the latch protrusion 14*a* has a spring tension against the upper guide member 15*a*.

The catch member 16 of the drive engagement mechanism includes an opening 16*a*, and is positioned into an engagement position 19 from the frame engagement side 28 of the fixed guide member. As shown at 210, the hoop or frame catch member 16 is separately guided into the channel 17 from the frame entry end 28, moving the catch member opening 16*a* along the channel 17 formed by the fixed guide members 15*a*, 15*b* to the engagement position such that the spring loaded latch mechanism 14 is displaced under the catch member 16 until the catch member opening 16*a* reaches the engagement position 19. At 220, the protrusion 14*a* of the stationary latch mechanism 14 meets the frame catch member 16 and engages a slot or opening 16*a* of the catch. The latch protrusion 14*a* includes at least one beveled edge 14*b*, which is adapted to allow the fixed guide member 15*a* and catch member 16 to displace the latch mechanism 14 when the latch mechanism 14 is moved against the fixed guide member 15*a* or the catch member 16. The fixed guide member 15*a* and the catch member 16, respectively, have reciprocally sloped bevels 16*b*, 15*c*, which facilitate the displacement of the latch mechanism 14 when moved against the fixed guide member 15 or the catch member 16.

At 220 the frame catch member 16 is placed at a position where a user can no longer move the frame catch member 16 further into the sewing apparatus, as for example, against a stop (not shown). At this point the protrusion 14*a* of the latch mechanism 14 partially engages the catch slot 16*a*, up to the point where the latch protrusion 15*a* abuts the upper fixed guide member 15*a*. This creates highly tactile engagement that is felt by a user as the latch mechanism 14 snaps into position. Accordingly, a user intuitively knows by this sensation that the frame 11 is engaged without needing to rely on a visual cue. At 230 the frame catch member 16 and latch mechanism 14, thus engaged, are moved into the machine workspace by the machine software (not shown). It will be noted that as the latch mechanism 14 moves the frame into the sewing apparatus, the latch fully engages the catch member as it passes out of the guide member 15.

Disengagement and removal of the embroidery frame 11 is accomplished by reversing steps 200-230. As with the engagement, the latch protrusion 14 includes the at least one beveled edge 14*b*, which allows the fixed guide member 15*a* to again displace the latch mechanism 14 when the latch mechanism 14 is moved against the fixed guide member 15*a* (as in going from step 230 to step 220). During disengagement, the fixed guide member's sloped bevel 15*c* facilitates the displacement of the latch mechanism 14 when moved against the fixed guide member 15.

The sewing apparatus 1 can be configured to have a plurality of thread feed mechanisms, shown as removable cartridges 100*a*, 100*b*, 100*c*, 100*d*. As shown in FIGS. 1A-1C, in one embodiment the sewing apparatus 1 comprises 4 cartridges. However, the apparatus as described herein could be adapted to include any number of cartridges 100*n*. Each cartridge could, for example, have a different colored thread, thereby allowing a preprogrammed embroidery pattern utilizing many different colors to be completed with fewer runs of the apparatus 1. For example a preprogrammed pattern with 4 colors could be completed in one run of the apparatus configured to simultaneously include 4 cartridges 100*a*, 100*b*, 100*c*, 100*d* each with threads of the corresponding colored threads. Because the cartridges 100*a*, 100*b*, 100*c*, 100*d* are each replaceable, a preprogrammed embroidery pattern including 8 or less colors could be completed in two runs on the embodiment including 4 cartridges.

Figure 4A:
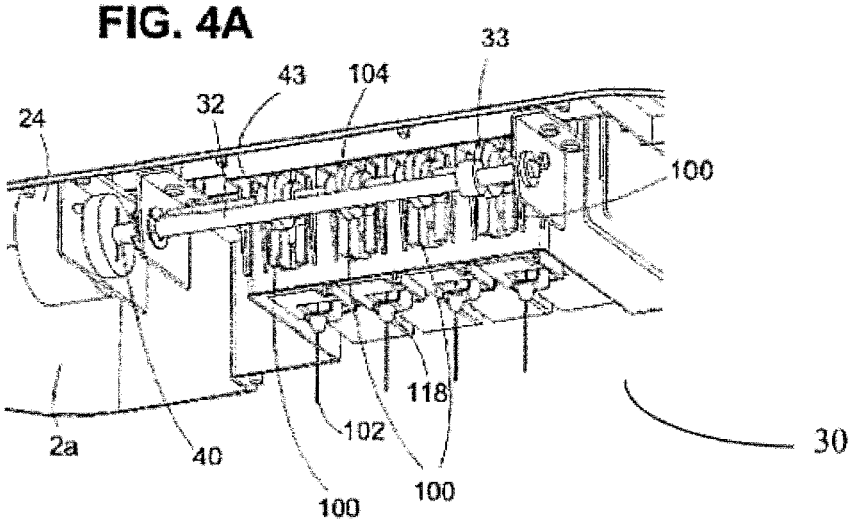
FIGS. 4A-4C show a thread feed cartridge selection and engagement mechanism.
Figure 4B:
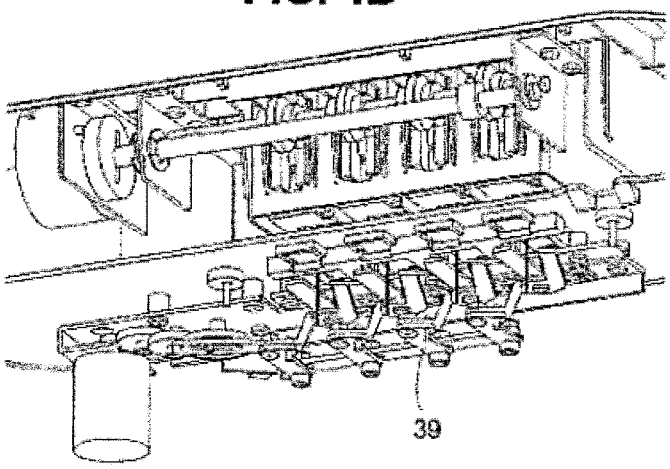
Figure 4C:
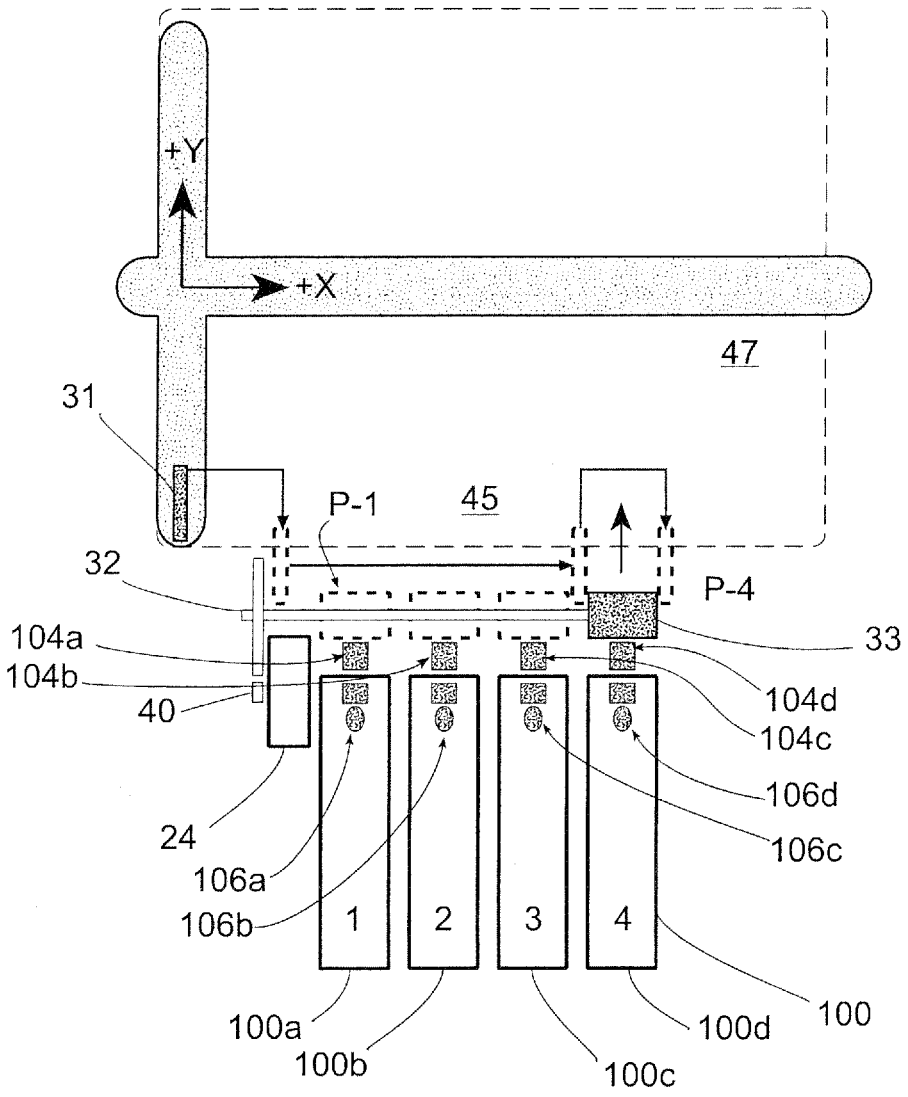

FIGS. 4A-4C show a thread feed cartridge selection and engagement mechanism 30 which is operatively connected to the embroidery frame driving mechanism 9. The sewing apparatus 1 comprising a fixed cartridge 100 and moving needle 102 (See FIGS. 5A-B) can reduce the power consumed in stitching the workpiece 18. Instead of moving the entire cartridge mass (including a large thread spool 103), the current embodiment moves only the needle 102 and related mechanisms of low-inertia design. This is accomplished by means of a gear train (described herein) that selectively transmits power from a drive motor 24 to a rack-mounted needle 102 within the cartridge 100. The reduced inertia of moving parts requires less energy to achieve the required accelerations in opposite directions on each stitching cycle.

FIG. 4A shows one embodiment of a system and method for a thread feed selection and engagement mechanism 30. As shown, the sewing apparatus 1 comprises a drive mechanism 24, a thread feed mechanism comprising a removable cartridge 100, and a needle engagement mechanism 104 for engaging the thread feed mechanism. The drive mechanism comprises a drive motor 24 configured to transmit power from the drive motor 24 to the needle engagement mechanism, such that the drive motor 24 drives a needle within the cartridge without moving the entire cartridge.

The thread feed selection and engagement mechanism 30 in the embodiment includes a spur gear transmission 32, comprising a movable output drive gear 33 capable of selective engagement with one of several installed cartridges 100*a*, 100*b*, . . . 100*n*, such that a single drive motor 24 can be employed to select and drive each cartridge in the apparatus 1 when a plurality of cartridges 100*a*, 100*b*, . . . 100*n* are installed.

In one embodiment, the selective engagement mechanism 30 is actuated by a complimentary function of the X-Y embroidery frame driving mechanism 9 and the controller 70 therefor, as described herein. The drive mechanism 9 and controller 70 are of a design otherwise commonly employed in embroidery machines as known to those of ordinary skill in the art (such as that shown in U.S. Pat. Nos. 6,729,253 and 6,729,254, the entirety of each of which is incorporated by reference herein). Thus one exemplary advantage of the selective engagement mechanism 30 is that it can be configured to work in conjunction with an existing mechanism to add functionality thereto.

The controller 71, and machine operating software 71*b*, 71*c* therefore, control the selective engagement mechanism 30 so as to arrange the selective engagement mechanism 30 to position a selector lever 31 at a predetermined location facilitating engagement from the Y-direction. This is followed by a sequence of coordinated movements of the selective engagement mechanism 30 in the X-Y directions, a first sweep of the selective engagement mechanism 30 intended to intercept and move a keyed drive gear mechanism 33 from any position on the drive shaft 32 to a predetermined position at the end of the sweep, and a second sweep of the selective engagement mechanism 30 in the opposite direction terminating so as to position the keyed drive gear mechanism 33 in the location of engagement with the drive mechanism 104 of the desired cartridge 100.

In one exemplary embodiment, the drive shaft 32 is operatively connected to the drive motor 24 and at least one drive gear 33 positioned on the shaft. The drive motor can comprise a variable speed motor (e.g., a stepper motor). The drive gear 33 is configured such that it can slide from position to position on the shaft 32.

Within a physically limited length interval, a drive shaft 32 comprises a physical configuration including, for example, a shaped cross section such that a keyed drive gear 33 of suitably matched cross section mounted thereon is constrained from rotating about and relative to the axis the shaft 32, and remains free to slide parallel to the axis. Such configurations can be of a non round shape, but could also include a round cross-section with elements adapted to allow for driving the gear, such as a tab along the shaft 32 and a corresponding slot in a drive gear 33. Many specific configurations of shafts and gears accomplishing this purpose are well known in the art, such as the cross-sectional shapes including shapes a D shape, a round shape, a non-round shape, a clover shape, a notched shape, a triangular shape, a square shape, a polygonal shape, and a rectilinear shape.

In one embodiment, a D-shaft and keyed drive gear is utilized. The drive shaft 32 is a D-shaft, and the keyed drive gear 33 is positioned thereon to facilitate secure placement and rotation of the drive gear 33 when the shaft 32 is rotated by the drive motor 24.

The range of X-direction movement of the keyed drive gear 33 on the keyed drive shaft 32 is limited to maintain positional control at all times and without risk of jamming, by ensuring that the selector can be safely positioned to begin each sweep outside the allowed range of drive gear movement on the shaft. The controller 70 is further configured to position the frame driving mechanism 9 (including the selector 31 in an area 45 outside of a work area 47 for the workpiece) to position the selector 31 to engage the drive gear 104.

As shown in FIG. 4C the controller 70 is configured to position the selector outside the work area by moving the frame mechanism in the Y-direction. 25. The controller 70 is further configured move the selector 31 in a first sweep to intercept and move the keyed drive gear 33 from any position on the drive shaft 32 to a predetermined position at the end of the sweep, and a second sweep in the opposite direction terminating so as to position the keyed drive gear 33 in the location of engagement (positions 1-4) with the drive mechanism 104 of the thread feed mechanism 100. The controller 70 is further configured to limit the range of X-direction movement of the drive gear 33 on the drive shaft 32, such that the selector 31 is positioned to begin each sweep outside the limited range of drive gear 33 movement on the shaft 32. Additionally the drive shaft 32 can also be physically configured to mechanically limit the range of X-direction movement of the drive gear 33 on the drive shaft 32 such that the selector 31 is positioned to begin each sweep outside the limited range of drive gear 33 movement on the shaft 32. For example, the drive shaft 32 can include a shaped cross-section such as a D-shaft. The drive gear 33 is keyed to the D-shaft and slideably positioned on the shaped cross-section to move along its axis, as described herein. The longitudinal cut of the cross-section on the shaft 32 can end in a position that limits the X-direction movement of the drive gear 33 on the drive shaft 32, as, for example where the keyed D cross-section in the gear 33 abuts the shaft 32 at a point where the D-cut cross-section into the shaft 32 ends.

The needle drive mechanism includes an idler gear 104 in a housing positioned to engage the drive gear and the thread feed mechanism 100. A selector 31 is attached to the frame driving mechanism 9. The selector 31 is configured to engage the drive gear 104 with the thread feed mechanism, and move the drive gear to any position (for example, 4 positions corresponding to the 4 cartridges 100*a*-100*d*). As shown in FIGS. 4A-4C, needle engagement mechanisms 104*a*-104*d* are configured to engage the drive gear 33 to each of the cartridges. The controller 70 is configured to move the frame driving mechanism 9 to position the drive gear such that the drive gear engages the thread feed mechanism 100. A reduction gear 40 and drive shaft 40 are provided between the drive shaft 32 and the drive motor 24 to control the torque delivered from the drive motor 24. A locking mechanism 43 locks the drive gear 33 when the drive gear 33 engages a removable cartridge 100. In one embodiment, the locking mechanism 100 can include a detent on the drive shaft 32 to lock the drive gear 33 into a position wherein it can drive the needle engagement mechanism without slipping or sliding out of position. The detent is configured to lock the gear into position yet also allow the selector to move the gear between positions thread feed mechanisms 100*a*-100*d*.

The needle engagement mechanism can be configured to engage at least one thread feed mechanism, the thread feed mechanism comprising a removable cartridge. This can be accomplished by selecting at least one drive gear, and moving the drive gear to engage the at least one thread feed mechanism. The controller 70 moves the frame driving mechanism to position the drive gear such that the drive gear engages the thread feed mechanism 100. The engagement mechanism 30 slides the at least one drive gear 33 to a needle engagement position, the drive gear being mounted on a shaft operatively connected to a drive motor 24 for driving the thread feed mechanism 100. The frame 11 is positioned outside of a work area for a workpiece 18 when selecting and moving the drive gear 33. For example, when selecting and moving the drive gear, the X-Y frame driving mechanism 9 moves the frame 11 in the Y-direction. The selector 31 is then positioned to engage a sequence of coordinated movements in the X-Y directions, so as to position the drive gear 33 such that the drive gear 33 engages a drive mechanism 104 of the thread feed mechanism.

The positioning of the selector 11 includes moving the selector 11 in an X direction to a first drive gear 33 position (any of p-1 to p-4), moving the selector 11 in a Y direction to select the drive gear 33, and then sliding the drive gear 33 in an X direction from the first drive gear position on the drive shaft to a second position on the drive shaft (any of p-1 to p-4 other than the first position), the second position being the location of engagement with the drive mechanism 104 of the thread feed mechanism 100. As the FIG. 4C shows, the range of X-direction movement of the drive gear 33 on the drive shaft 32 is such that the selector 11 is positioned to begin each sweep outside the limited range of drive gear 33 movement on the shaft 32. The drive gear 33 is locked when the drive gear 33 engages the thread feed mechanism 100. Power is then transmitted from a drive mechanism 24, for example a stepper motor, to the needle engagement mechanism 106 such that it drives a needle 102 within the cartridge 100.

In one embodiment, as described herein, the mechanism can drive the needle 102 without moving the entire cartridge 100. The sewing apparatus 1 comprises a device configured to actively feed embroidery thread out of a cartridge 100 through a hollow needle 102. One advantage is that a thread break at or near the needle tip is automatically overcome through normal operation of the sewing apparatus 1. Other exemplary advantages include: (a) enabling automatic recovery of the stitching function in the case of thread breakage during embroidery; (b) eliminating any requirement for user adjustment or trimming of thread from the cartridge, prior to use or storage; and (c) enabling a complimentary function for thread cutting on the underside of the workpiece using a cutter assay (See FIG. 4B, 39) thereby reducing or eliminating the need for manual thread trimming at the start, finish or at "jump stitches" in the embroidered pattern.

In another aspect, disclosed is a mechanism to enforce thread advancement on each downward plunge of the needle, and further inhibit reverse thread motion on the return stroke, and methods therefor.

Figure 5A:
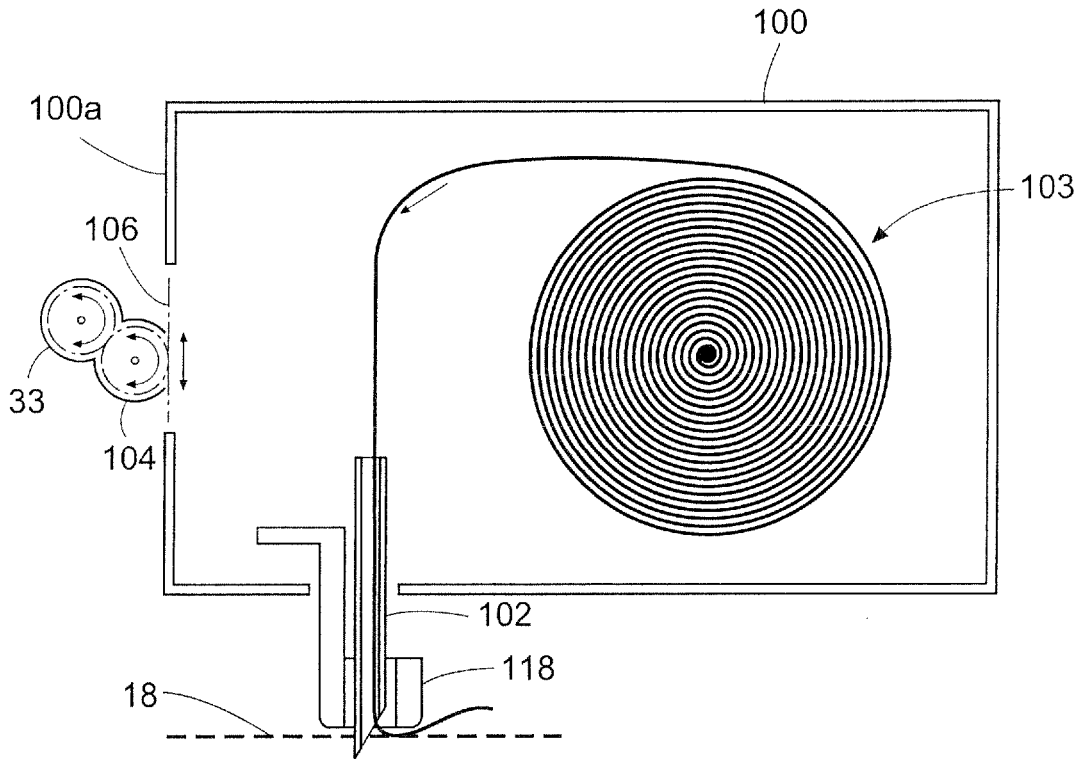
FIGS. 5A-5D show embodiments of a thread feed mechanism.
Figure 5B:
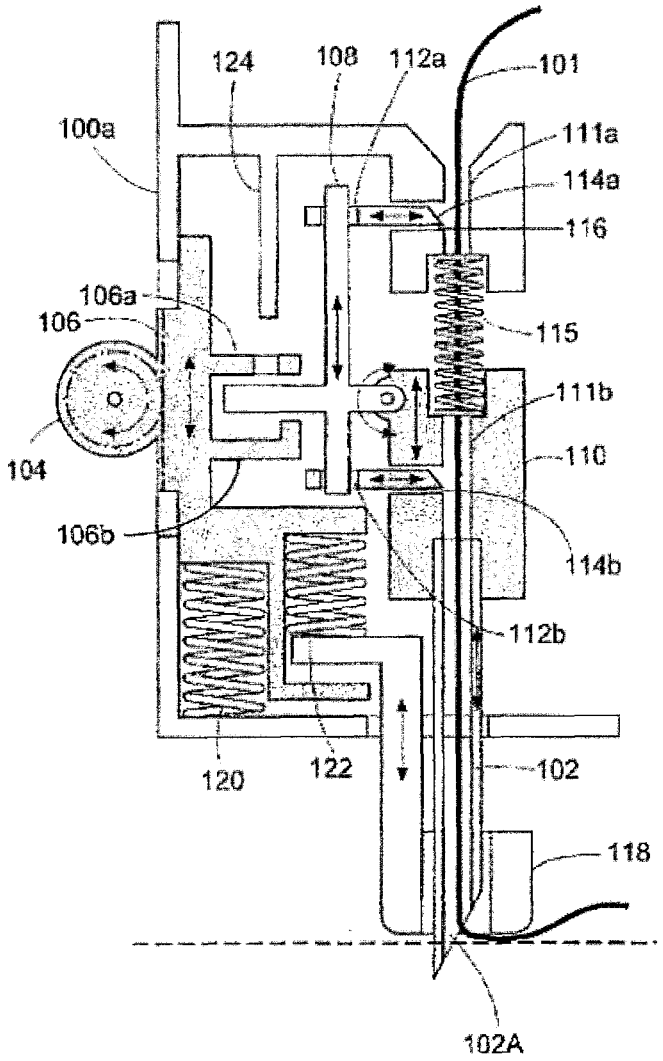

FIGS. 5A-B show embodiments of a thread feed mechanism including a cartridge 100. FIG. 5B shows the embodiment of the cartridge 100 comprising a double-acting lever mechanism configured to alternately engage both moving and non-moving thread locks.

A replaceable cartridge 100 contains a thread spool 103 and a pre-threaded hollow needle 102, which are configured to be mounted within the sewing apparatus 1. The replaceable cartridge 100 also includes mechanisms for independent needle and thread motion control.

A rack slider 106 is mounted in the cartridge body 100*a*, the rack slider 106 being constrained to allow only translation in the vertical axis. The rack slider 106 is operatively connected to the needle drive gear 104. This drive gear 104 delivers intermittent rotary motion to the rack slider 106, which receives and follows that motion. As described above with respect to FIGS. 4A-4D, the needle drive gear 104 is ultimately driven by the drive motor 24 (embodied hereby as a stepper motor 24 which delivers intermittent rotary energy). In one embodiment, the drive gear 104 can be a keyed or ridged gear adapted to engage ridges on the rack slider 106.

The rack slider 106 is configured to engage a thread control lever 108, such that the thread control lever 108 is at first rotated against a stop 106*a*, 106*b* (shown in the embodiment as unitary with the rack slider 106) according to the direction of rack slider 106 motion, then further constrained to translation following the rack slider 106 over a remaining stroke length.

A fulcrum 107 of the thread control lever 108 is fixed to a thread feed body 110, such that the thread control lever 108 in a first stage movement first rotates about a pivot to engage at least one thread lock 114 (discussed below), and then causes translation of the thread feed body 110 in a second stage movement. Intermittent rotary motion of the drive gear 104 is received and followed by the rack slider 106 mounted in the cartridge body 100*a*, the rack slider 106 being constrained to allow only translation in the vertical axis.

The thread feed body 110 includes a constraining channel 111 for thread passage, and a lateral slot 112 through which the thread control lever 108 can engage thread lock 114B, thereby preventing motion of the thread 101 through the channel 111 during downward motion only. It will be understood the thread control lever may also engage the thread lock by a hinged connection 114B or such connection as to allow the thread control lever to engage the thread lock 114B The thread feed body 110 receives both the needle 102 and an extension guide element (embodied as extension guide spring 115) fixed to the thread feed body 110 at opposite ends.

The thread 101 is passed through the extension guide spring 115, which is fixed on the upper end of a receiving feature 116 on the cartridge body 100. The extension guide spring acts to constrain the thread 101 at all times against significant bending, kinking, or looping within the passages formed through the cartridge body 100*a*, extension guide spring 115, and the constraining channel 111B of the thread feed body 110.

The cartridge body further contains a lateral slot 112A through which the thread control lever 108 may engage thread lock 114A, thereby preventing motion the thread in a fixed channel 111A (here shown in the fixed cartridge 100*a*) during upward motion only. It will be understood the thread control lever may also engage the thread lock 114A by a hinged connection, or by such connection as to allow the thread control lever to engage the thread lock 114A.

A cylindrical presser foot 118 surrounds and is coaxial with the needle 102. The presser foot 118 is mounted on or otherwise operatively connected to the rack slider 106, such that the presser foot 118 is configured to move with the rack slider 106. The presser foot 118 is further controlled by a return spring 122, which is positioned to maintain a position of full extension as against the presser foot 118 unless bearing against the workpiecc 18. As shown in FIG. 5B, the return spring 122 is shown as positioned between the presser foot 118 and the rack slider 106.

A second return spring 120 is positioned to maintain the rack slider 106 at the upper limit of travel, until overcome by force exerted on the rack slider 106 by the drive gear 104. As shown in FIG. 5B, the compression return spring 122 is shown as positioned between the presser foot fixed cartridge 100*a* and the rack slider 106.

The return springs are shown as a compression return springs, but each could be any spring chosen as appropriate, including extension springs, torsion springs, or other such springs as known to those of ordinary skill in the art.

A thread lock arm 124 of the cartridge body 100*a* is positioned to engage the thread control lever 108 and thread lock 114B in the feed body 110, such that the thread 101 cannot be freely withdrawn from the cartridge 100 when the needle is positioned at the upper limit of travel.

The result of the above-described functions is that thread 101 is positively advanced with the needle on each downward stroke of the needle 102, and thread thus advanced is further constrained against return with the needle 102 on each upward (return) stroke. In this way, thread 101 is actively advanced from the open tip 102A of the needle 102 by an amount nearly equal to the downward stroke length of each cycle. It will be noted that while the described embodiment shows two thread locks 112A, 112B, the cartridge 100 could be configured to allow a single thread lock 112 to both constrain the movement of the thread to follow the needle on the downstroke and constrain the thread to stay stationary as the needle moves on an upstroke (not shown).

It follows that a mechanism arranged to adjustably control the stroke length, also positively controls the advance of thread from the cartridge 100 through the needle tip 102A. Such control, in coordination with separate control of the lateral movement of an embroidery workpiece (not shown), enables the following exemplary functions and features:

- Programmed, coordinated control of the machine mechanisms to optionally produce satin stitches or chenille loop stitches on the front design side of the workpiece.
- Active replenishment of thread 101 from the needle tip 102A in the event of thread breakage within the needle 102 during operation of the machine, further enabling self-recovery of stitching in the event of thread breakage during embroidery.
- Advancement of thread 101 from the needle tip 102A below the underside of the workpiece (not shown), further enables automated cutting of the thread 101 by a mechanism (FIG. 4D, 39) provided for such purpose, resulting in the following advantages:
  - attached, loose thread ends need not remain on the front design side at the start or finish of stitching of a pattern; and
  - a continuous "jump stitch" need not remain on the front design side between segments of a pattern;
- where each of these conditions otherwise requires manual trimming by the machine operator following machine embroidery by prior art means.

One embodiment of controlling the above described thread feeding mechanism will now be explained.

Figure 8A:
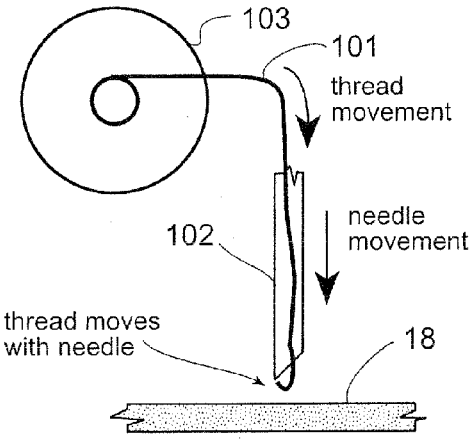
FIGS. 8A and 8B show, respectively, how a fixed thread position is maintained relative to the needle tip during downward motion of the needle to make a stitch, and how a static position of the thread relative to the workpiee is maintained during the upward motion of the needle after a stitch has been made.
Figure 8B:
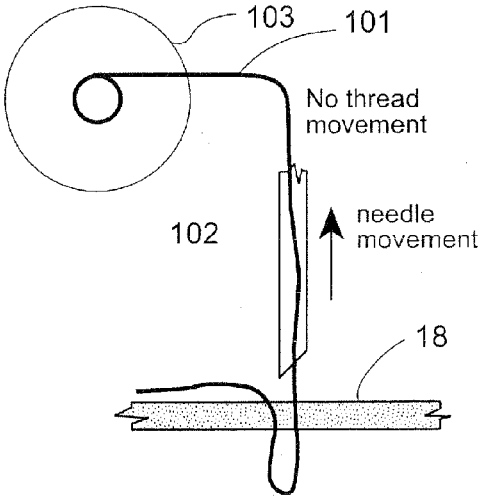

As shown in FIG. 8A, the thread feeding mechanism described above (including the rack slider 106, thread feed body 110, and upper and lower thread locks 114A, 114B) maintains a fixed thread position relative to the needle tip during downward motion of the needle to make a stitch (i.e. pulling thread 101 from the spool 103), since the lower thread lock 114B engages the thread 101 when a stitch is made. As shown in FIG. 8B, the thread feeding mechanism maintains a static position of the thread 101 during the upward motion of the needle 102 after a stitch has been made (i.e. the needle 102 glides over the thread 101 without pulling, leaving the thread 101 fixed in position relative to the anchoring position of the previous stitch), since the upper thread lock 114A is engaged with the thread 101 at this point. With this system, tensioning of the stitches is accomplished by control of the feeding of the appropriate amount of thread 101 through controlling the up and down motion of the needle 102 and the engagement and disengagement of the thread locks 114 (i.e., upper thread lock 114A being disengaged and lower thread lock 114B being engaged when needle 102 moves down; and upper thread lock 114A being engaged and lower thread lock 114B being disengaged when needle 102 moves up). This control is accomplished by variable determination of the top of the needle stroke and the bottom of the needle stroke, on a stitch by stitch basis.

Figure 9:
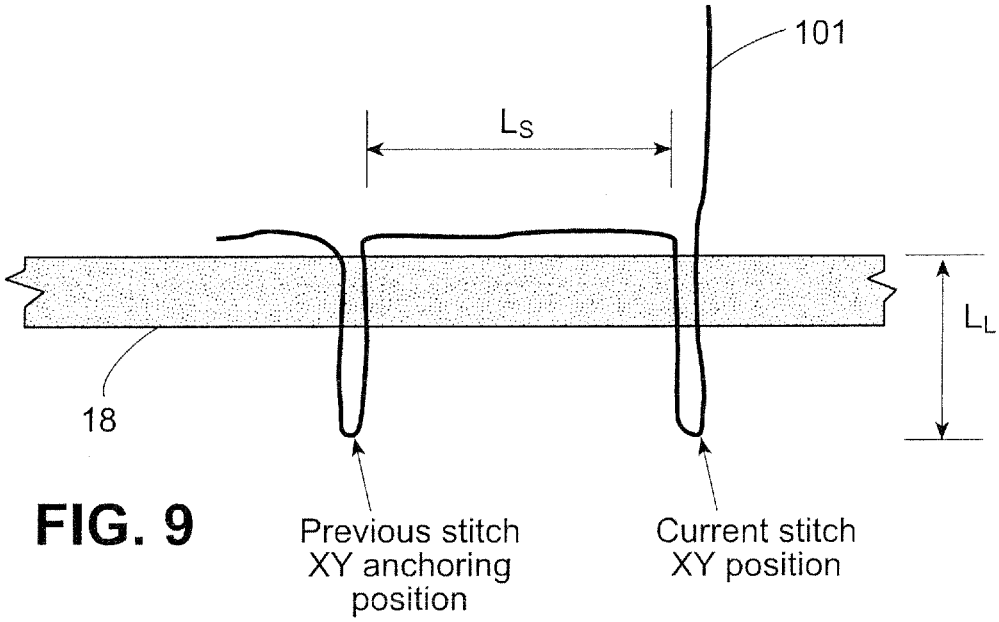
FIG. 9 shows various parameters required by the controller in order to determine a first amount of thread needed to make a stitch.

To this affect, referring now to FIG. 9, the controller 70 is configured to calculate a first amount of thread $A_{T1}$ needed for a particular stitch by using the following formula:

$$A_{T1}=L_S+L_L-C_1;$$

where $L_S$ is the desired stitch length (i.e., the distance from one stitch anchoring XY position to the next stitch anchoring XY position in the current needle cycle); $L_L$ is the desired length of the loop formed on the underside of the workpiece 18 as measured from the top surface of the workpiece 18 (i.e., the amount of thread 101 needed for appropriate anchoring of the stitch in the backing material); and $C_1$ is a small constant which is subtracted to ensure that the appropriate thread tension is provided between stitches.

Figure 10:
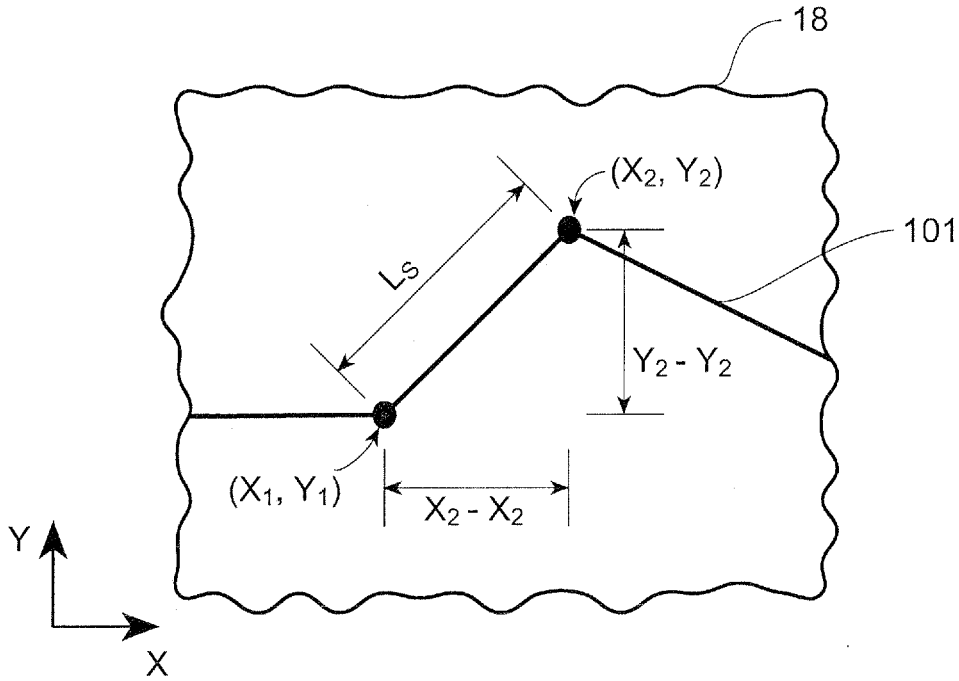
FIG. 10 shows a top side view of a portion of the workpiece in which one stitch has been made at location X1,Y1 and a next stitch has been made at location X2,Y2.

FIG. 10 shows a top side view of a portion of the workpiece 18 in which one stitch has been made at location $X_1,Y_1$ and a next stitch has been made at location $X_2,Y_2$. The controller 70 often times must also be configured to calculate the desired stitch length $L_S$ based on the known desired movement of the workpiece 18 from one stitch location $X_1,Y_1$ to the next stitch location $X_2,Y_2$. In this case, the controller 70 is configured to calculate the desired stitch length $L_S$ by using the following formula:

$$L_S=[(X_2X_1)^2+(Y_2-Y_1)^2]^{1/2};$$

where $X_1$ is the position of the first stitch in the X direction of the horizontal plane of the workpiece 18; $Y_1$ is the position of the first stitch in the Y direction of the horizontal plane of the workpiece 18; $X_2$ is the position of the next stitch in the X direction; and $Y_2$ is the position of the next stitch in the Y direction.

Figure 11:
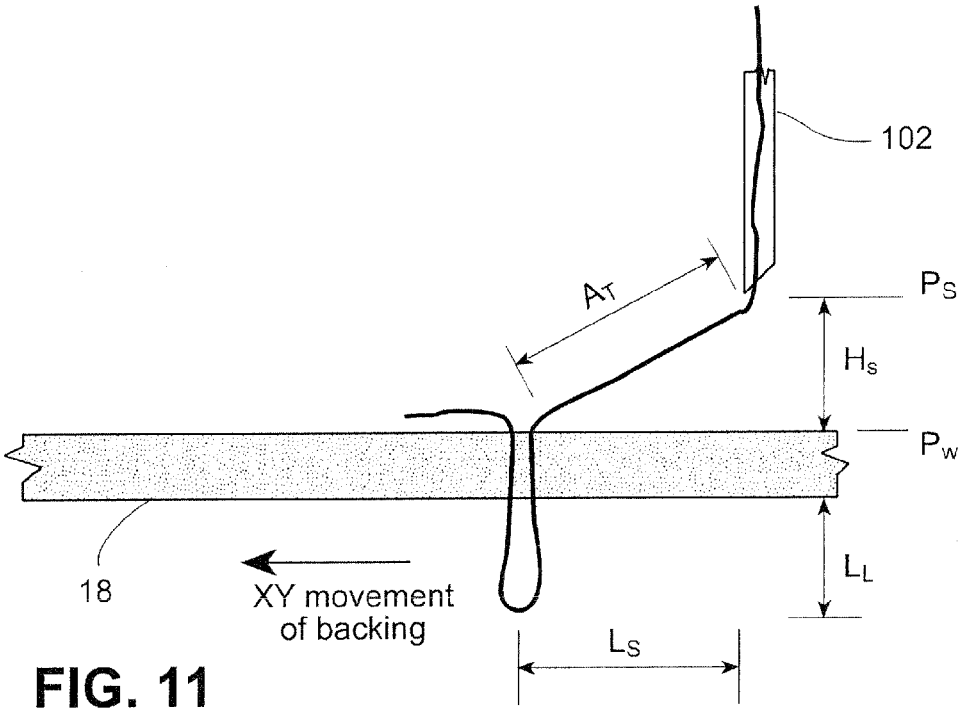
FIG. 11 shows a situation where the desired loop length is smaller than the height of a slack position of the needle.

In addition, as shown in FIG. 11, there may be a situation where the desired loop length $L_L$ is smaller than the height $H_S$ of a slack position $P_S$ (discussed below with reference to FIGS. 11 and 12) of the needle 102 above the position $P_W$ of the top of the workpiece 18 to allow for movement of the workpiece 18 to the next stitch location. In such a situation, it may be the case that the amount of thread 101 needed to move the workpiece 18 from a first XY position to a second XY position will be more than the first amount of thread $A_{T1}$ calculated by the controller 70. If this is the case, only playing out the first amount of thread $A_{T1}$ from the spool 103 will result some of the thread 101 being pulled out of the previous stitch. This undesirably shortens the length of the prior thread loop, and could possibly result in the prior thread loop being pulled out of the workpiece 18 entirely. Thus, the first amount of thread $A_{T1}$ calculated by the controller 70 may actually be less than the actual amount of thread $A_T$ required to form the next stitch without unduly weakening the previous stitch.

To account for such a situation, the controller 70 is configured to calculate a second amount of thread $A_{T2}$ needed for a particular stitch by using the following formula:

$$A_{T2}=[L_S^2+H_S^2]^{1/2}$$

The controller is configured to compare the first amount of thread $A_{T1}$ with the second amount of thread $A_{T2}$, and use the greater of the two amounts as the actual amount of thread $A_T$ which is to be played out from the spool 103.

To account for the case where the controller 70 determines that the second amount of thread $A_{T2}$ should be used, the controller is configured to increase the length $L_L$ of next loop made (when the controller uses $A_{T2}$ as the actual amount of thread $A_T$ needed to make the next stitch) by the following formula:

$$L_{Lnew}=(A_{T2}-L_S)+C_2;$$

where $L_{Lnew}$ is the newly determined desired length $L_L$ of next loop; and $C_2$ is a small constant which is added to ensure that the appropriate thread tension is provided between stitches (the constant $C_2$ may be the same value as that of the constant $C_1$, or it may be a different value from that of the constant $C_1$).

Figure 12:
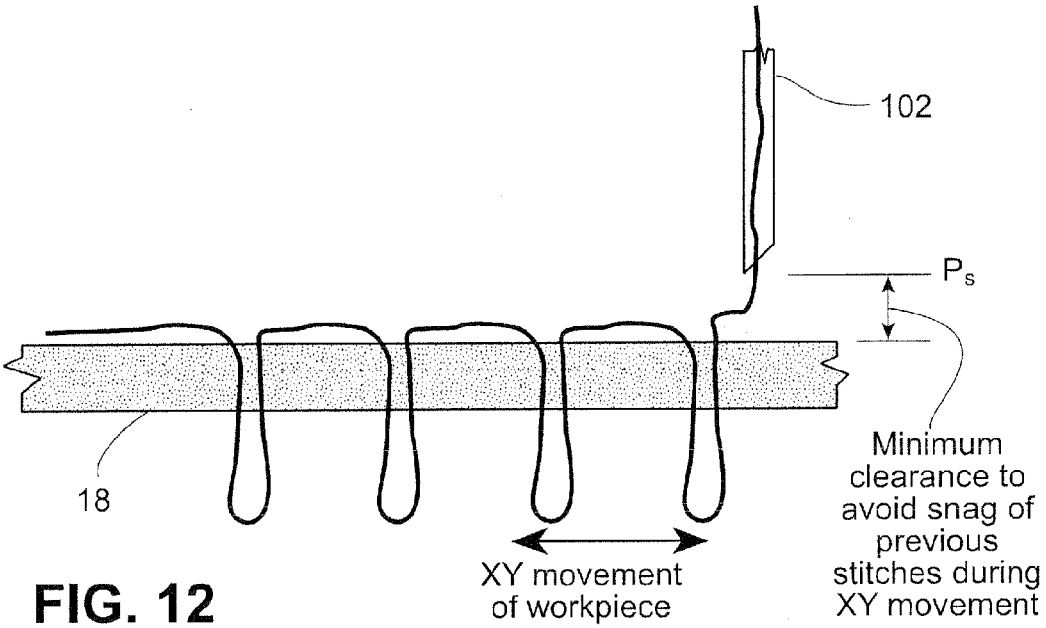
FIG. 12 shows how, between needle cycles, the needle is positioned at a slack position during the XY movement of the workpiece 18.

Referring to FIG. 12, between needle cycles (i.e., one down and up cycle of the needle 102), the workpiece 18 is moved in XY dimensions relative to the needle 102 to provide the correct location for the next stitch. During the XY movement of the workpiece 18, the needle 102 must be positioned a minimum distance above the top surface of the workpiece 18 to allow for workpiece 18 to move in XY dimensions without the tip of the needle 102 snagging on the workpiece 18 or the threads of previous stitches. This minimum distance is referred to as the slack position $P_S$, and has been determined to generally be in the range of 1 mm to 4 mm. Accordingly, the slack position $P_S$ changes each time a new current position $P_W$ of the top of the workpiece is determined (discussed below).

Figure 13A:
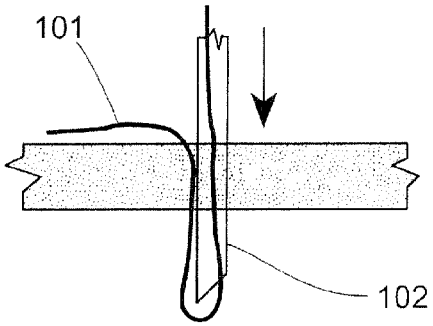
FIGS. 13A-13E show the needle cycles through up/down movements and the workpiece moves in XY directions to form the stitches.
Figure 13B:
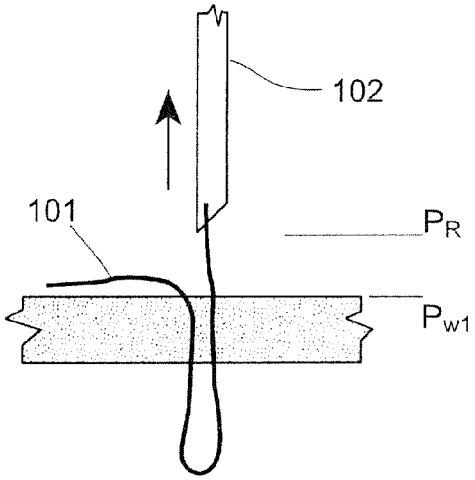

Before the needle 102 can come to rest at the slack position $P_S$ so that the workpiece 18 can be moved, a minimum amount of thread 101 for making the next stitch must first be played out from the spool 103. Thus, after forming a stitch as shown in FIG. 13A, the lower thread lock 114B disengages from the thread 101 and the upper thread lock 114A then engages the thread 101 so as to prevent the thread 101 from moving while the needle 102 is removed from the workpiece 18. Then, as seen in FIG. 13B, the needle 102 is moved to a rest position $P_R$ above the top surface of the workpiece 18. Generally, the rest position $P_R$ corresponds to a distance above the vertical position $P_{W1}$ of the top surface of the workpiece 18 that is equal to the amount of thread $A_T$ needed for a next stitch (i.e., $P_R=P_{W1}+A_T$).

Figure 13C:
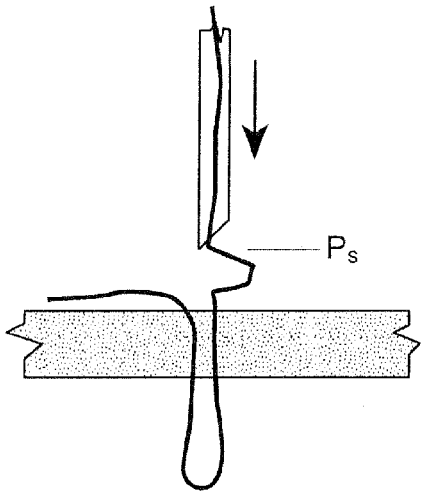

The controller 70 is configured to determine the rest position $P_R$ based, in part, on a signal received from a sensor 65 (described below in relation to FIGS. 6A-6D). More specifically, the controller 70 receives a signal from the sensor 65 upon the downward stroke of the needle 102 indicating the vertical position $P_{W1}$ of the top of the workpiece 18. The controller then adds the amount of thread $A_T$ needed to the vertical position $P_{W1}$ in order to obtain the rest position $P_R$ of the needle 102. After the needle 102 is moved to the determined rest position $P_R$, the needle 102 is then moved to the slack position $P_S$ (as shown in FIG. 13C), pulling thread 101 from the spool 103, so that the workpiece 18 can be moved in XY dimensions.

However, there is a physical limitation to how high the needle 102 can move. As such, the situation may occur when the maximum rest position $P_{Rmax}$ of the needle 102 is not at a sufficiently great enough distance from the vertical position $P_{W1}$ of the top of the workpiece 18 to provide all of the amount of thread $A_T$ needed to form the next stitch (i.e., the determined rest position $P_R$ is greater than the maximum rest position $P_{Rmax}$). In this situation, the needle 102 is moved up to the maximum rest position $P_{Rmax}$ and then down to the slack position $P_S$. The controller 70 is configured to calculate a second rest position $P_{R2}$, in such a situation, by the following formula:

$$P_{R2}=P_{S1}+[A^T-(P_{Rmax}-P_{W1})];$$

where $P_{S1}$ is a slack position of the needle 102 above the current position $P_{W1}$ of the top of the workpiece.

Since the needle movement positions are typical calculated in terms of the current position $P_W$ of the top of the work piece, another version of the above formula is:

$$P_{R2}=P_{W1}+H_S+[A_T-(P_{Rmax}-P_{W1})].$$

Since the slack height $H_S$ is equal to the difference between the slack position $P_S$ and the position $P_W$ of the top of the work piece, yet another version of the above formula is:

$$P_{R2}=P_{W1}+[A_T-(P_{Rmax}-P_{S1})].$$

In case the situation arises where the second determined rest position $P_{R2}$ also exceeds the maximum allowed rest position $P_{Rmax}$, the controller is configured to repeat the above process as many times as is needed to play out the entire amount of thread needed for the next stitch.

Figure 13D:
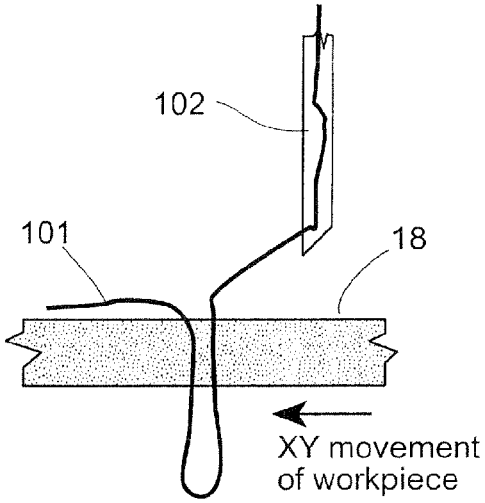
Figure 13E:
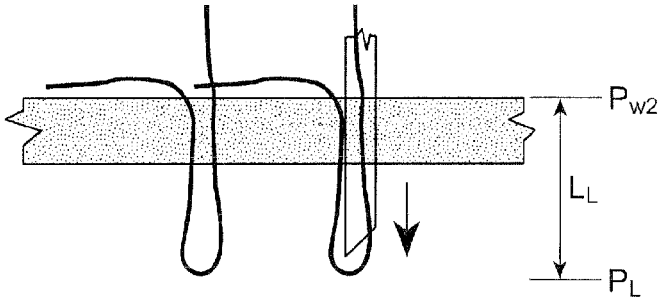

As shown in FIG. 13D, once the entire amount of thread needed for the next stitch has been played out from the spool 103, the needle 102 is brought to the slack position $P_S$ so that workpiece 18 may be moved in the desired XY directions. As shown in FIG. 13E, upon positioning of the workpiece 18 so that the needle 102 is located above the desired XY position of the next stitch, the needle 102 is then lowered through the workpiece 18 to the loop position $P_L$ corresponding to a distance below the current position $P_{W2}$ of the top surface of the workpiece 18 equal to the current desired loop length $L_L$. As with the first position $P_{W1}$ of the top surface of the workpiece 18, the controller 70 receives a signal from the sensor 65 upon the downward stroke of the needle 102 to form the second stitch, which indicates the current vertical position $P_{W2}$ of the top of the workpiece 18.

A preferable desired length of each loop formed on the underside of the workpiece 18 had been found to range from 0.5 mm to 4 mm. Accordingly, the controller 70 may be configured to take into account a desired loop length constant $L_{LC}$ when forming stitches.

More specifically, if the controller determined that the second amount of thread $A_{T2}$ should be used as the actual amount of thread $A_T$ used in the prior stitch, then the actual loop length $L_L$ created will be the new loop length $L_{Lnew}$, which will be greater than desired loop length constant $L_{LC}$. To adjust this longer loop length to be closer to the desired loop length constant $L_{LC}$, the controller may be configured to calculate the next first amount of thread $A_{T1next}$ needed for the next stitch by using the following formula:

$$A_{T1next}=L_S+L_{LC}-C_1-(2\cdot L_{Lnew}-2\cdot L_{LC}).$$

Similarly, next second amount of thread $A_{T2next}$ needed for the next stitch by using the following formula:

$$A_{T2next}=[L_S^2+H_S^2]^{1/2}-(2\cdot L_{Lnew}-2\cdot L_{LC}).$$

The controller is configured to compare the first amount of thread $A_{T1next}$ with the second amount of thread $A_{T2next}$, and use the greater of the two amounts as the actual next amount of thread $A_T$ which is to be played out from the spool 103.

To account for the case where the controller 70 determines (1) that the second amount of thread $A_{T2next}$ should be used, the controller is configured to repeat the process for increasing the length $L_L$ of next loop made as described above (when the controller uses $A_{T2next}$ as the actual next amount of thread $A_T$ needed to make the next stitch).

In this way, when making the next stitch, thread from the prior loop will be pulled out of the prior stitch, so as to shorten the original loop length $L_{Lnew}$ of the prior loop so that the final loop length is roughly equal to the desired loop length constant $L_{LC}$.

Accordingly, amount of thread used to make the loop of the prior stitch (originally at twice the loop length $L_{Lnew}$) will be reduced to be roughly equal to the amount of thread ($2\cdot L_{LC}$) needed to make a loop of the desired length $L_{LC}$ (i.e., an amount of thread to extend through the top surface of the workpiece 18 to the bottom of the loop of length $L_{LC}$, and then to extend from the bottom of the loop of length $L_{LC}$ back up through the top surface of the workpiece 18).

Thus, the up and down movements of the needle 102 are determined by controller 70 on a stitch-by-stitch basis, rather than being fixed as constant up and down movements to fixed top and bottom needle positions. This allows for greater control of the tensioning of each stitch, as well as greater control of the lengths of the thread loops created on the underside of the workpiece. Accordingly, a unique optimization of sewing stitch quality is able to be obtained.

As seen in the above described drawings, the various positions of the needle 102 are determined based on the tip of the needle. This is because this position of the needle also corresponds to the position at which the thread is attached to the needle in the shown embodiment (i.e., where the thread passes through a hollow needle). However, the up and down movements of a solid needle with a horizontal hole (e.g., an "eye") through which the thread passes can clearly also be determined on a stitch-by-stitch basis as above described above. In such a situation, the various positions of the needle 102 would be determined based on the horizontal hole of the needle (e.g., the position of the "eye" of the needle).

Figure 5C:
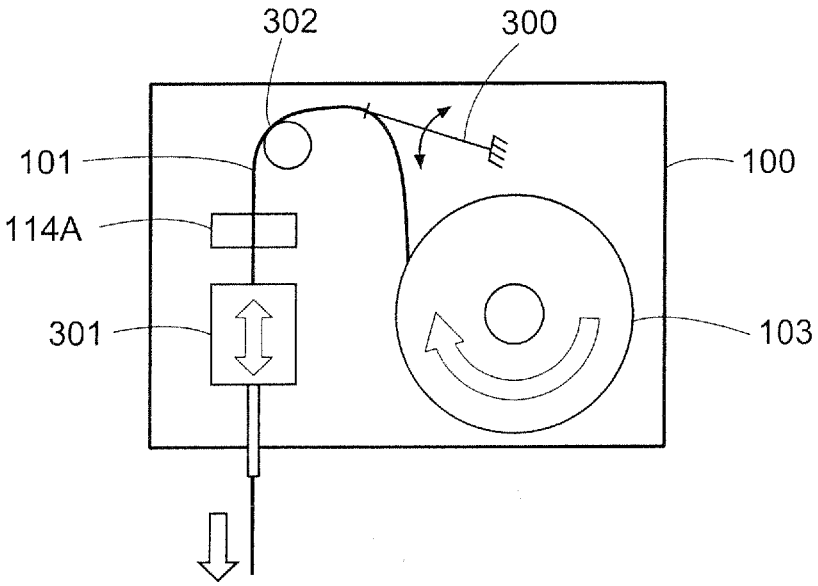
Figure 5D:
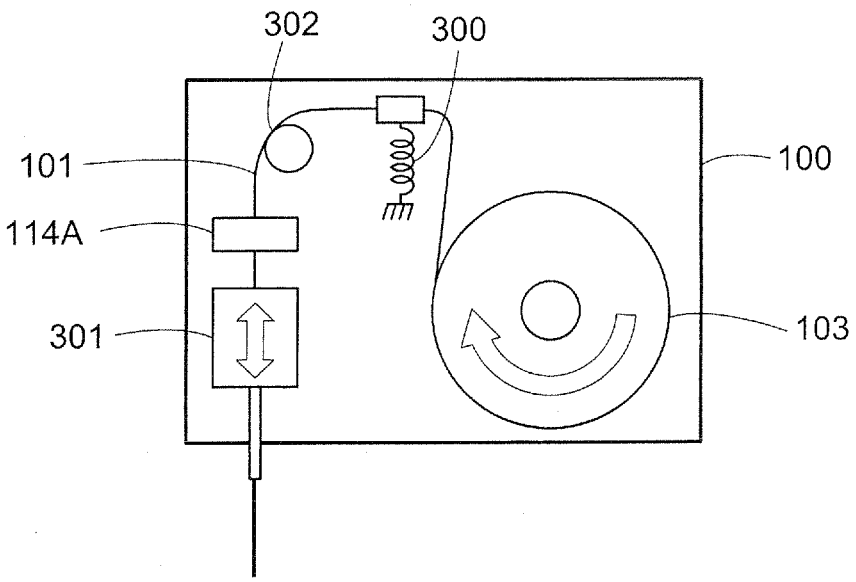

As shown in FIG. 5C, a further embodiment adds a force deflection device 300 to the thread path between the spool 103, and the needle drive mechanism 301 (which includes the rack slider 106, thread feed body 110, and lower thread lock 114B) and upper thread lock 112A. In this embodiment, the force deflection device 300 is in the form of a spring.

The needle drive mechanism 301 accelerates during the stitch cycle (i.e., the downward stroke of the needle 102), consequently pulling the thread 101 with an abruptly increased force. The spool 103 and cartridge interface are designed to at least partially resist spinning of the spool. The sudden acceleration applied to the thread 101 by the needle drive mechanism, combined with the inertial force applied to the thread 101 by the spool 103 and the resistance to spinning of spool 103 be design, abruptly increases the tension on the thread 101, which can lead to uneven thread tension during the stitching process.

It is desirable to try and maintain a relatively smooth and gradual, increase and decrease in thread tension. Accordingly, the force deflection device 300 is designed to deflect or deform when the needle drive mechanism 301 accelerates during the stitch cycle. In this way, some of the initial force applied by the needle drive mechanism 301 to the thread 101 during the stitch cycle is transferred to the force deflection device 300, rather than having all of that initial force transferred directly to the spool 103.

Thus, the force deflection device 300 is able to reduce the sudden increase in tension typically experienced by the thread 101. In this way, the deformation of the force deflection device 300 acts to absorb the peak energy applied by the needle drive mechanism 301 to the thread 101. This creates a more uniform tension in the thread to reduce the likelihood of thread slippage in the thread feeding device (e.g., the needle drive mechanism 301), as well as to reduce the likelihood of spool over-spinning and over-pulling the thread 101.

In the particular embodiment of FIG. 5C, the spring 300 is placed in the thread path between the spool 103 and a thread guide 302, which serves to guide the thread from the spool 103 into the upper thread lock 114A and the needle drive mechanism 301. As the needle drive mechanism 301 accelerates downward, the thread 101 is pulled off the spool 103. This creates tension in the thread 101 as the spool 103 resists spinning, primarily from inertia (as well as inherent friction and friction by design in the spool/cartridge interface). As the tension in the thread 101 increases, the spring 300 further deflects in a downward motion.

In this embodiment, the spring 300 is designed as a cantilever beam with a stiffness that is optimized to operate within the range of needle drive acceleration and amount of thread on spool (the diameter of thread on the spool affects spool inertia, from engineering theory). However, the force deflection device 300 could take the form of a coiled spring which deforms by compressing when the needle drive mechanism 301 accelerates downward. In other words, the exact form of the force deflection device 300 is not important, so long as it is designed to deform to absorb some of the initial force applied by the needle drive mechanism 301 to the thread 101.

The force deflection device 300 should be optimized to operate within the range of needle drive acceleration, amount of thread on the spool, and friction in the spool/cartridge interface. It has been determined that the initial force applied by the needled drive mechanism 301 to the thread 101 is in the range of 10 to 100 g-force, with around 50 g-force being a commonly applied initial force. Thus, the force deflection device 300 best serves its purpose when designed to deform under such an applied force range. As such, the material used to make the force deflection device 300 can be a metal, a rubber, a plastic, or any other material with an elastic property such that it will deform when 10 to 100 g-force is applied, and then return to its initial shape when the needled drive mechanism 301 no longer applies a feeding force to the thread 101. To address the commonly applied initial force of 50 g-force, the material used to make the force deflection device 300 might be chosen such that the deflection device 300 only deforms when at least 50 g-force is applied thereto.

Furthermore, while the usefulness of the force deflection device 300 has been explained in the context of feeding thread for a sewing or embroidery machine, the force deflection device 300 has applicability beyond this context. More specifically, the force deflection device 300 can be applied to any device or process which serves to feed, pull, draw, or otherwise remove a material from a spool. For example, the force deflection device 300 could be applied to a situation where rope or chain material is to be fed from a spool. All that would be required is to adjust the force range in which the force deflection device 300 deforms to absorb the initial feed force.

A workpiece embroidered by the single-thread sewing device described above will further require a separate means for permanent retention of the stitches in the workpiece. This may be accomplished by separate application of an adhesive to secure the thread loops to each other or to the underside of the workpiece.

Employment of the described mechanism can be further extended, in principle, to sewing by the lockstitch method, with addition of a second thread and accompanying stitch interlocking mechanism (i.e., rotary hook) on the underside of the workpiece (not shown).

As shown in FIGS. 6A-6D, disclosed is a detection device and method therefor, comprising a sensor positioned to detect the physical movement of a needle drive mechanism 301 in a sewing apparatus. As shown in the embodiment, the needle drive mechanism 301 includes moving mechanisms of the thread feed mechanism 100 as described above (see FIGS. 5A-5C), such as the thread feed body 110 and the presser foot 118. While the embodiments described herein show exemplary removable cartridges 100 configured to allow each needle drive mechanism 301 to move while the corresponding fixed cartridge 100 is stationary, it will be understood that the detection mechanism 60 can be used with sewing apparatuses 1 in which where the entire cartridge 100 moves with the needle drive mechanism 301, as shown in U.S. Pat. Nos. 6,729,253 and 6,729,254 (the entirety of each of which is incorporated by reference herein).

In one embodiment lever 63, is added underneath the embroidery deck 61. The lever 63 is able to pivot. When the needle drive mechanism 301 moves downward during the downward stroke and contacts the lever 63, the resulting downward movement of the lever 63 actuates a sensor 65 such as a mechanical switch or photo interrupter. From this actuation, the position of the needle 102 is known. Depending on the configuration of the lever 63 and sensor 65, the needle position can be detected with high precision.

A drive mechanism 24 can be, for example, a steady drive motor such as a DC drive motor 24. However, in an embroidery machine 1 using a variable or intermittent drive mechanism 24 (such as a stepper motor 24 for driving the needle drive mechanism 301), the stepper motor 24 can lose position if subjected to too high of a load. If this occurs, the position of the needle 102 may no longer be known if operating in open loop control. This can result in significant degradation of stitch quality.

A lever is mounted underneath the embroidery deck 61 in the configuration of a cantilever beam as shown in the embodiment of FIGS. 6 A-D, thereby creating a closed loop system. The lever is attached to the deck 61 using a hinge 64 such as a piece of plastic, metal, or any other deformable material that meets the functional requirements of the detection mechanism 60. It will be noted that embodiments of the device 60 include embodiments where elements such as the lever 63, hinge 64 and needle plate 62 are each separately incorporated into the deck. Also, one or more of these elements can be unitarily formed as parts of the deck 61, as for example, by a one-piece injection molded deck 61 including the lever 63, hinge 64 and needle plate 62.

The up position is shown in FIG. 6A. As the needle drive mechanism 301 moves downward, the presser foot 118 contacts the workpiece 18, which in turn contacts the needle plate 62, resulting in the downward pivot of the lever 63. The needle plate 62 positioned on the lever 63, such that the downward motion of the presser foot 118 on a workpiece 18 causes the workpiece 18 to contact the needle plate 62 so that the lever 63 contacts the sensor 65, shown as a mechanical switch. In the down-most position of the lever 63 (shown in FIG. 6B), the sensor 65 is actuated and the lever 63 contacts the stop 66, which stops or substantially stops the downward motion of the lever 66. With the stop 66, the lever 66 is unable to over-travel, thus preventing wear and possible damage to the switch 65. It will be noted that while the embodiment shows the needle plate 62 is attached to the lever 63, the device could be configured in any number of ways to affect a lever 63 and/or needle plate 62 to actuate a sensor 65.

In another embodiment, instead of the lever 66 contacting a mechanical switch 65, a flag could be attached to the lever 63 such that the lever 66 actuates a photo interrupter (not shown). The sensor 65 can comprise an emitter such as a light source and a detector such as photodiode. A flag can be positioned on the lever 63 such that it interrupts a signal between the emitter and the detector, for example, a light signal to the photodiode.

In each of the embodiments, the distances from the pivot or hinge 64 to the switch 65, needle plate 62, and stop 66 can be optimized for range of motion and force.

As explained above, depending on the configuration of the lever 63 and sensor 65, the needle position can be detected with high precision. At least one of the pivot point 64 for the lever 63, the sensor 65, and the stop 66 can be positioned to optimize at least one of a range of motion of deflection as well as a force. The device 60 can further be configured such that at least one of the pivot point 64, the sensor 65, and the stop 66 is positioned to optimize at least one of the desired qualities of the sewing apparatus. Such desired qualities may include reduced wear on the device 60 from repeated operation, as well as stitch delivery from the needle mechanism to the workpiece 18. For example, the force on the needle plate 62 required to actuate the switch 65 can be adjusted by shifting the position of the needle plate 62 relative to the pivot 64. The factors for the optimizing the configuration are expressed as follows in conjunction with FIG. 6E:

Force:

$F_{NP=((D^{SW}/D_{NP})*F_{SW})}$+force contribution from hinge stiffness (assuming contribution from mass of lever and needle plate are negligible)

Deflection:

$\theta=\tan^{-1}(d_{SW}/D_{SW})$ $d_{NP}=\tan(\theta)*D_{NP}$ $d_{ST}=\tan(\theta)*D_{ST}$ where:

$F_{NP}$=needle plate force $F_{SW}$=switch force $\theta$=angular deflection of lever $D_{NP}$=horizontal distance from pivot to needle plate $D_{SW}$=horizontal distance from pivot to switch $D_{ST}$=horizontal distance from pivot to stop $d_{NP}$=vertical deflection of needle plate $d_{SW}$=vertical deflection of lever at switch $d_{ST}$=vertical deflection of lever at stop As incorporated into the sewing apparatus 1 the sensor 65 included in the detecting mechanism 60 is configured to detect the physical movement of the needle mechanism. The sensor 65 sends a signal to the controller 70, such that the sensor 65 and the drive mechanism 24 form a closed feedback loop operable to allow the CPU 71A to track the position of the needle drive mechanism 301 of the thread feed mechanism 100 with respect to a workpiece 18 for the needlework during operation.

As shown in FIGS. 6C-6D, the sewing apparatus 1 comprises a plurality of the thread feed mechanisms 100. The detection mechanism 60 and the drive mechanism 33 for each thread feed mechanism 100 form a closed feedback loop, which is operable to track the position of each of the thread feed mechanisms 100 (including the needle drive mechanism 301) with respect to a workpiece 18 for the needlework during operation. The sewing apparatus 1 comprises a plurality of the sensors 65. Each of the plurality of sensors 65 are configured to detect the movement of the each of the thread feed mechanisms 100, as well as determine the position of each needle 102 with respect to the workpiece 18 during operation of the sewing apparatus.

Although exemplary embodiments of the present invention and modifications thereof have been described in detail herein, it is to be understood that this invention is not limited to these precise embodiments and modifications, and that other modifications and variations may be effected by one skilled in the art without departing from the spirit and scope of the invention as defined by the appended claims.

What is claimed is:

1. A sewing apparatus comprising:

a needle drive mechanism comprising a drive motor, a shaft operatively connected to the drive motor, and at least one drive gear positioned on the shaft, wherein the needle drive mechanism includes an idler gear positioned to engage the drive gear to a thread feed mechanism;

the thread feed mechanism comprising a plurality of cartridges each having a movable needle within, wherein at least one cartridge is removable; and a needle engagement mechanism comprising a selector configured to engage the at least one drive gear with the thread feed mechanism; and wherein the drive motor is configured to transmit power from the drive motor to the needle engagement mechanism such that it drives the movable needle without moving the entire cartridge.

2. The sewing apparatus of claim 1, wherein the needle engagement mechanism further comprises a controller and a frame, wherein the controller is configured to move a frame driving mechanism to position the drive gear such that the drive gear engages the thread feed mechanism; and wherein the selector is attached to the frame driving mechanism.

3. The sewing apparatus of claim 2, wherein the frame driving mechanism is an X-Y frame driving mechanism, and wherein the controller is further configured to position the frame driving mechanism including the selector outside of a work area for a workpiece such that the selector is positioned to engage the drive gear.

4. The sewing apparatus of claim 3, wherein the controller is further configured to position the selector outside the work area by moving the frame mechanism in a Y-direction.

5. The sewing apparatus of claim 4, wherein the controller is further configured to position the selector to engage a sequence of coordinated movements in X-Y directions, so as to position the drive gear such that the drive gear engages the thread feed mechanism.

6. The sewing apparatus of claim 5, wherein the controller is further configured to move the selector in a first sweep to intercept and to move the drive gear from any position on the drive shaft to a predetermined position at the end of the sweep, and a second sweep in the opposite direction terminating so as to position the drive gear in a location of engagement with the thread feed mechanism.

7. The sewing apparatus of claim 1, wherein the needle engagement mechanism further comprises a spur gear transmission.

8. The sewing apparatus of claim 1, wherein the drive motor is a variable speed motor.

9. The sewing apparatus of claim 1, wherein the drive shaft has a shaped cross-section; and wherein the drive gear comprising a keyed drive gear slidably positioned on the shaped shaft, whereby the drive gear is securely engaged when the shaft is rotated by the drive motor.

10. The sewing apparatus of claim 9, wherein the cross-sectional shape is selected from the group consisting essentially of a D shape, a round shape, a non-round shape, a clover shape, a notched shape, a triangular shape, a square shape, a polygonal shape, and a rectilinear shape.

11. The sewing apparatus of claim 6, wherein the controller is further configured to move the drive gear on the drive shaft in a limited range in X-direction such that the selector is positioned to begin each sweep outside the limited range of drive gear movement on the shaft.

12. The sewing apparatus of claim 11, wherein the drive shaft is physically configured to mechanically limit the range of X-directional movement of the drive gear on the drive shaft such that the selector is positioned to begin each sweep outside the limited range of drive gear movement on the shaft.

13. The sewing apparatus of claim 12, wherein the drive shaft comprises a shaped cross-section; and the drive gear comprises a keyed drive gear slidably positioned on the shaped cross-section, wherein the shaped cross-section on the shaft ends in a position that limits the X-directional movement of the drive gear on the drive shaft.

14. The sewing apparatus of claim 2, further comprising a locking mechanism to lock the drive gear into a position where the drive gear engages the thread feed mechanism.

15. The sewing apparatus of claim 6, further comprising a reduction gear.

16. The sewing apparatus of claim 1, wherein the sewing apparatus is an embroidery apparatus.

17. A sewing apparatus comprising:

a plurality of thread feed mechanisms, wherein at least one thread feed mechanism comprises a removable cartridge including a needle;

a needle engagement mechanism comprising a selector configured to select and engage at least one drive gear with each of the thread feed mechanisms, a shaft operatively connected to a drive motor, and a controller configured to move a frame driving mechanism to position the drive gear such that the drive gear engages the thread feed mechanism; wherein the at least one drive gear is slidably positioned on the shaft, and wherein the selector is attached to the frame driving mechanism.

18. The sewing apparatus of claim 17, wherein the frame driving mechanism is an X-Y frame driving mechanism, and wherein the controller is further configured to position the frame driving mechanism including the selector outside of a work area for a workpiece such that the selector is positioned to engage the drive gear.

19. The sewing apparatus of claim 18, wherein the controller is further configured to position the selector outside the work area by moving the frame mechanism in a Y-direction.

20. The sewing apparatus of claim 19, wherein the controller is further configured to position the selector to engage a sequence of coordinated movements in X-Y directions, so as to position the drive gear such that the drive gear engages the thread feed mechanism.

21. The sewing apparatus of claim 20, wherein the controller is further configured to move the selector in a first sweep to intercept and to move the drive gear from any position on the drive shaft to a predetermined position at the end of the sweep, and a second sweep in the opposite direction terminating so as to position the drive gear in a location of engagement with the thread feed mechanism.

22. The sewing apparatus of claim 21, wherein the drive shaft has a shaped cross-section; and wherein the drive gear comprising a keyed drive gear slidably positioned on the shaped shaft, whereby the drive gear is securely engaged when the shaft is rotated by the drive motor.

23. The sewing apparatus of claim 22, wherein the cross-sectional shape is selected from the group consisting essentially of a D shape, a round shape, a non-round shape, a clover shape, a notched shape, a triangular shape, a square shape, a polygonal shape, and a rectilinear shape.

24. The sewing apparatus of claim 22, wherein the controller is further configured to move the drive gear on the drive shaft in a limited range in X-direction such that the selector is positioned to begin each sweep outside the limited range of drive gear movement on the shaft.

25. The sewing apparatus of claim 22, further comprising a locking mechanism to lock the drive gear into a position where the drive gear engages the thread feed mechanism.

26. The sewing apparatus of claim 17, wherein the sewing apparatus comprises an embroidery apparatus.

27. The sewing apparatus of claim 17, wherein the sewing apparatus further comprises a needle drive mechanism configured to transmit power to the needle engagement mechanism such that it drives the needle within the cartridge without moving the entire cartridge.

28. The sewing apparatus of claims 10, 13 and, or 23 wherein the drive shaft including a D-shaped cross-section.

* * * * *